US005453348A

United States Patent [19]

Kuse et al.

[11] Patent Number: 5,453,348

[45] Date of Patent: Sep. 26, 1995

[54] IMAGE FORMING METHOD FOR SILVER . . . MATERIALS

[75] Inventors: Satoru Kuse; Masao Ishikawa; Shigeharu Koboshi, all of Hino, Japan

[73] Assignee: Konica Corporation, Japan

[21] Appl. No.: 303,239

[22] Filed: Sep. 8, 1994

Related U.S. Application Data

[63] Continuation of Ser. No. 66,625, May 24, 1993, abandoned, which is a continuation of Ser. No. 611,487, Nov. 1, 1990, abandoned, which is a continuation of Ser. No. 309,838, Feb. 10, 1989, abandoned.

[30] Foreign Application Priority Data

Feb. 15, 1988 [JP] Japan ..... 63-32501
Mar. 2, 1988 [JP] Japan ..... 63-48931

[51] Int. Cl.[6] ..... G03C 5/38; G03C 5/395; G03C 7/34; G03C 7/42

[52] U.S. Cl. ..... 430/385; 430/384; 430/398; 430/400; 430/393; 430/430; 430/461; 430/963

[58] Field of Search ..... 430/398, 400, 430/393, 430, 461, 963, 385, 384

[56] References Cited

U.S. PATENT DOCUMENTS

| | | | |
|---|---|---|---|
| 4,242,442 | 12/1980 | Idota et al. | 430/430 |
| 4,818,664 | 4/1989 | Ueda et al. | 430/430 |
| 4,822,725 | 4/1989 | Abe et al. | 430/430 |
| 4,845,017 | 7/1989 | Kishimoto et al. | 430/430 |
| 4,933,266 | 6/1990 | Stephen et al. | 430/430 |
| 4,933,666 | 6/1990 | Stephen et al. | 430/430 |
| 4,983,503 | 1/1991 | Ishikawa et al. | 430/393 |
| 4,985,347 | 1/1991 | Fujimoto et al. | 430/393 |

FOREIGN PATENT DOCUMENTS

| | | | |
|---|---|---|---|
| 0255726 | 2/1988 | European Pat. Off. . | |
| 0293729 | 12/1988 | European Pat. Off. | 430/461 |

OTHER PUBLICATIONS

Patent Abstr. of Japan, vol. 9, No. 308 (p. 410[0092](2031) Dec. 5, 1985, Abstr. of JP 60–140345.

Patent Abstr of Japan, vol. 12, No. 88 (p. 678)(2935), Mar. 23, 1988 Abstr. of JP 62–222252.

*Primary Examiner*—Richard L. Schilling

*Attorney, Agent, or Firm*—Jordan B. Bierman; Bierman and Muserlian

[57] ABSTRACT

An image forming method for silver halide color photographic light-sensitive material is disclosed. The method is excellent in stability and rapidness of processing. And in the photographic color image formed by the method, staine formation due to storage is inhibited in unimaged area of the picture. The method is comprises steps of developing an imagewise exposed silver halide color photographic material with a color developer, bleaching with a bleaching solution, immediately after the developing step, and treating, after the bleaching step, with a solution having fixing capability. The bleaching solution contains a ferric complex salt of a compound represented by the following formula A, and the solution having fixing capability contains at least one of thiocyanate and an iodide in a total amount of not less than 0.5 mol per liter of the solution, (A)

wherein A, through $A_4$ are each a $—CH_2OH$ group, a —COOM group or a $—PO_3M^1M_2$ group, which may be the same with or different from each other, M, $M^1$ and $M^2$ are each a hydrogen atom, a sodium atom, a potassium atom or an ammonium group; X is a substituted or unsubstituted alkylene group having 3 to 6 carbon atoms.

16 Claims, No Drawings

IMAGE FORMING METHOD FOR SILVER . . . MATERIALS

This application is a continuation of application number 08/066,625, filed May 24, 1993, now abandoned, which is a continuation of application number 07/611,487, filed Nov. 01, 1990, now abandoned, which is a continuation of application number 07/309,838, Feb. 10, 1989, now abandoned.

FIELD OF THE INVENTION

The present invention relates to an image forming method for silver halide color photographic materials (hereinafter also simply referred to as 'light-sensitive materials') and, particularly, to an image forming method for light-sensitive materials in which stain can be inhibited form producing in an unexposed area of the light-sensitive material in storage and rapid processing can be performed.

BACKGROUND OF THE INVENTION

Light-sensitive material processing basically comprises color developing and desilvering processes; desilvering comprises bleaching and fixing processes or a bleach-fixing process. Rinsing, stabilization and other processes may be added.

In processing solution with bleaching capability used to desilver light-sensitive materials, ferricyanates, bichromates, and other inorganic oxidizing agents have conventionally been widely used to bleach image silver.

However, some critical drawbacks are pointed out in processing solutions with bleaching capability containing these inorganic oxidizing agents. For example, ferricyanates and bichromates are undersirable in preventing environmental pollution in that they may be decomposed by light to produce harmful cyan ions or hexavalent chromium ions, though they are relatively high in image silver bleaching power. Another drawback is that it is difficult to regenerate roy reusing these processing solutions without discarding the waste liquid after processing.

In response to the requirements of less problems of environmental pollution, rapid and simple processing, reuse of waste liquid, and others, processing solutions containing metal complex salts of organic acids, such as aminopolycarboxylic acid, as oxidizing agent have become used. However, such processing solutions are faulty in that the bleaching rate (oxidation rate) of image silver (metallic silver) formed in the developing process is low due to weak oxidation power. For example, iron (III) complex salt of ethylenediaminetetraacetic acid, considered relatively strong in bleaching power among metal complex salts of aminopolycarboxylic acid, is now in practical use in bleaching solutions and bleach-fixers, but it is faulty in that bleaching power is insufficient and much time is taken in the bleaching process when used for high-sensitivity silver halide color photographic light-sensitive materials composed mainly of a silver bromide or silver iodobromide emulsion, specifically silver-rich color paper for picture taking and color negative and color reversal films for picture taking which contain silver iodide.

In addition, developing methods using automatic developing machine etc. to continuously process large amounts of light-sensitive materials necessitate a means of keeping the processing solution components in a given range of concentration to avoid reduction of bleacher performance due to changes in component concentrations. To meet this requirement, as well as to increase economy and prevent environmental pollution, some methods were proposed, including the method in which concentrated replenishers are added in small amounts and the method in which overflow solutions are supplemented with regenerating agents and then reused as replenishers.

As regards bleachers, a method is now in practical use in which a ferrous complex salt of organic acid formed in bleaching developed silver, e.g. iron (II) complex salt of ethylenediaminetetraacetic acid, is oxidized by airation to iron (III) complex salt of ethylenediaminetetraacetic acid, i.e. ferric complex salt of organic acid, and a ragenerating agent is added to replenish the deficient components, then the solution is used as a replenisher.

In recent years, however, what is called compact-labos (also called minilabos) have become widely established with the aim of reducing processing time for silver halide color photographic light-sensitive materials and delivery cost; in these labos, there are severe needs of process simplification and reduction of developing machine installation space, so regeneration is unsuitable since it necessitates troublesome procedures and maintenance, as well as additional processing space.

It is therefore preferable to use the replenishing method with small amounts of thick replenishers without regenerating process; however, when the amount of replenisher is extremely small, there occurs an increase in the concentration of color developer components transferred to the bleaching solution, and the solution becomes likely to be affected by evaporative concentration; these increase the accumulation of color developer components. As stated above, when the color developer component concentration in the bleaching solution increases, there occurs an increase in the ratio of contaminant reducing components, such as color developing agent and sulfites, bleaching reaction is inhibited, and what is called desilvering failure becomes likely to occur. To overcome these drawbacks, it was proposed to use ferric complex salts of aminopolycarboxylic acid disclosed in Research Disclosure No. 24023 and Japanese Patent Publication Open to Public Inspection No. 62-222252/1987 and their mixtures. However, even this method proved to have various drawbacks. For example, ferric propylenediaminetetraacetic acid complex salts are described in the above-given literatures or in the patent publications laid open to public inspection. Such complex salts will produce the so-called sulfurization phenomenon which will decompose thiosulfate that is to serve as a fixing agent, when the complex salts adhered to a light-sensitive material are brought together into a successive fixing or bleach-fixing solution during they are processed, though such complex salts have a strong oxidizing capability. In particular, the above-mentioned disadvantage will be more emphasized when reducing a replenishing amount of a fixing or bleach-fixing solution.

In recent years, 'mini-labs' tend to use the so-called waterless treatment, namely, a stabilizing treatment, in which any washing treatment is not carried out, but specific chemicals are used with a great reduction of washing water. In this treatment, unexposed areas tend to be seriously stained while allowing to stand. This tendency is getting more emphasized recently in rapid processing.

SUMMARY OF THE INVENTION

It is, therefore, an object of the invention to provide an improved method of image forming for a light-sensitive material, which is capable of rapidly processing the light-sensitive material, excellently preventing stains in unexposed areas easpecially in allowing the light-sensitive material to stand, and preventing a precipitation.

Another object of the invention is to provide a method of image forming of a light-sensitive material, which is excellent in processing stability and capable of carrying out a continuous processing extending over a long period of time and a small quantity processing on occasions, either.

The above objects of the invention is achieved by an image forming method comprising steps of developing an imagewise exposed silver halide color photographic light-sensitive material with a color developer bleaching the silver halide color photographic light-sensitive material, immediately after the developing step, with a bleaching solution, and treating the silver halide color photographic light-sensitive material, after the bleaching step, with a solution having fixing capability, wherein the bleaching solution contains a ferric complex salt of a compound represented by the following formula A, and the solution having fixing capability contains at least one of thiocyanate and an iodide in a total amount of not less than 0.5 mol per liter of the solution,

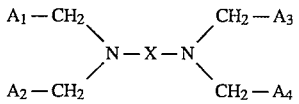

(A)

wherein $A_1$ through $A_4$ are each a $—CH_2OH$ group, a -COOM group or a $—PO_3M^1M_2$ group, which may be the same with or different from each other, M, $M^1$ and $M^2$ are each a hydrogen atom, a sodium atom, a potassium atom or an ammonium group; X is a substituted or unsubstituted alkylene group having 3 to 6 carbon atoms.

DETAILED DESCRIPTION OF THE INVENTION

The effects of the invention can be displayed only in the cases that a bleaching solution containing a specific ferric organic acid complex salt is used in a treatment of a light-sensitive material with a solution having fixing capability such as a fixing solution or a bleach-fixing solution succesively after a bleaching treatment is carried out, and that specific amounts of thiocyanate and/or iodide are contained in a solution having fixing capability such as a fixing or bleach-fixing solution with which the succesive treatment is carried out. This invention cannot be accomlished if any of the above-mentioned requirements should not be satisfied.

Now, the invention will be detailed below. First, the compounds represented by the above-given Formula-A, which is contained in the bleaching solution used in the processing method of the invention, will be detailed.

As mentioned before, $A_1$ through $A_4$ may be the same with or the different from each other, and they represent each $—CH_2OH$, —COOM or $—PO_3M^1M^2$ in which M, $M^1$ and $M^2$ each represent a hydrogen atom, a sodium atom, a potassium atom or an ammonium group; X represents a substituted or unsubstituted alkylene group having 3 to 6 carbon atoms, such as a propylene group and a pentamethylene group; and the substituents include, for example, a hydroxyl group.

The preferable examples of the compounds represented by the foregoing Formula A include the following compounds.

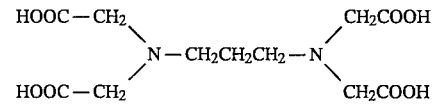

A-1

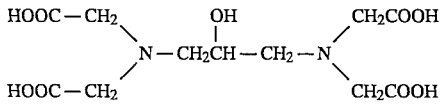

A-2

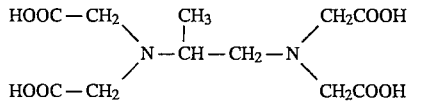

A-3

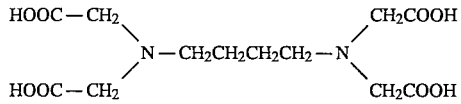

A-4

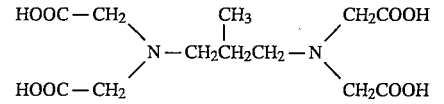

A-5

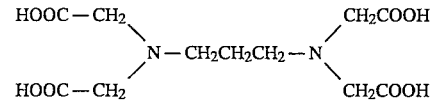

A-6

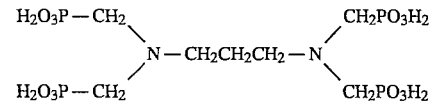

A-7

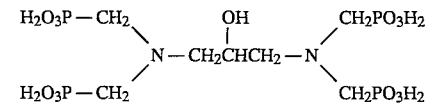

A-8

The compounds represented by Formula-A include the compounds A-1 through A-8 and, besides, the sodium, potassium or ammonium salts thereof. In particular, the ferric ammonium complex salts thereof may preferably be used for a bleaching agent.

Among the examples of the above-given compounds, the particularly preferable compounds include A-1, A-2, A-4, and A-7 and, inter alia, A-1.

Ferric complex salts of the compounds represented by the foregoing Formula A, may be used in an amount within the range of from 0.002 to 0.4 mol per liter of a bleaching solution, more preferably, from 0.01 to 0.3 mol and, inter alia, from 0.05 to 0.55 mol.

In the invention, a bleaching solution is used by adding thereto at least one kind of the ferric complex salts of the compounds represented by Formula A and, besides, other ferric aminopolycarboxylic acid complex salts such as ferric ethylenediaminetetraacetic acid complex salt, ferric diethylenetriaminepentaacetic acid complex salt, ferric 1,2-cyclohexanediaminetetraacetic acid complex salt, ferric glycoletherdiaminetetraacetic acid complex salt and so forth may also be used in combination. Inter alia, the combination of the ferric complex salt of the invention and ferric ethylenediaminetetraacetic acid complex salt is preferably used from the viewpoints of economization and bleach-fog diminution.

Where a bleaching solution and bleach-fixer preferably contain imidazole and the derivative thereof or at least one kind of the compounds represented by the following Formulas I through IX as a bleaching accelerator, there also displays an effect preventing the precipitates which are produced due to the presence of the silver contained in the bleaching solution. Therefore, such bleaching solution and bleach-fixers should preferably be used.

Formula I

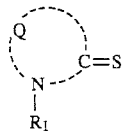

wherein Q represents a group consisting of atoms which are necessary to complete a nitrogen-containing heterocyclic ring including a ring condensed with a 5- or 6-membered unsaturated ring; and $R_1$ represents a hydrogen atom, an alkyl group having 1 to 6 carbon atoms, a cycloalkyl group, an aryl group, a heterocyclic group including those each condensed with a 5- or 6-membered unsaturated ring, or an amino group.

Formula II

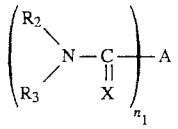

wherein $R_2$ and $R_3$ each represent a hydrogen atom, an alkyl group having 1 to 6 carbon atoms, a hydroxy group, a carboxy group, an amino group, an acyl group having 1 to 3 carbon atoms, an aryl group or an alkenyl group; A represents

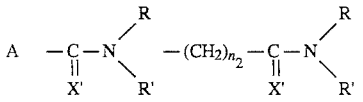

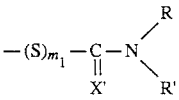

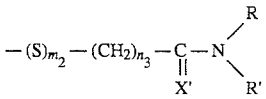

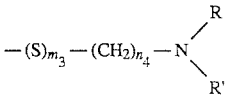

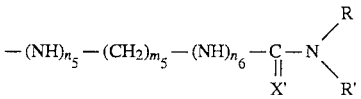

-continued

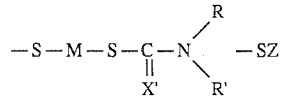

or an $n_1$ valent heterocyclic residual group including those condensed with a 5- or 6-membered unsaturated ring; X represents =S, =O or =NR", in which R and R' each are synonymous with $R_2$ and $R_3$, X' is synonymous with X, Z represents a hydrogen atom, an alkali metal atom, an ammonium group, an amino group, a nitrogen-containing heterocyclic residual group, an alkyl group, or

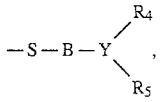

M represents a divalent metal atom, R represents a hydrogen atom, an alkyl group having 1 to 6 carbon atoms, a cycloalkyl group, an aryl group, a heterocyclic residual group including those each condensed with a 5- or 6-membered unsaturated ring, or an amino group, $n_1$ to $n_6$ and $m_1$ to $m_5$ each are an integer of 1 to 6, B represents an alkylene group having 1 to 6 carbon atoms, Y represents

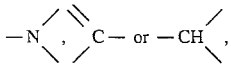

$R_4$ and $R_5$ each are synonymous with $R_2$ and $R_3$, provided that $R_4$ and $R_5$ each may represent —B—SZ and that $R_2$ and $R_3$, R and R' and, $R_4$ and $R_5$ each may also bond together so as to complete a ring.

The compounds represented by the above-given formula include an enolized substance and the salts thereof.

Formula III

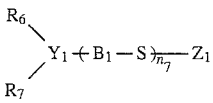

wherein $R_6$ and $R_7$ each represent a hydrogen atom, an alkyl group having 1 to 6 carbon atoms, a hydroxy group, a carboxy group, an amino group, an acyl group having 1 to 3 carbon atoms, an aryl group, an alkenyl group or —$B_1$—S—$Z_1$, provided that $R_6$ and $R_7$ are allowed to bond together to complete a ring; $Y_1$ represents

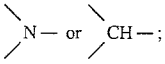

$B_1$ represents an alkylene group having 1 to 6 carbon atoms; $Z_1$ represents a hydrogen atom, an alkali metal atom, an ammonium group, an amino group, a nitrogen-containing heterocyclic residual group or

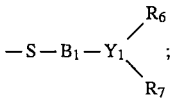

$n_7$ is an integer of 1 to 6.

Formula IV

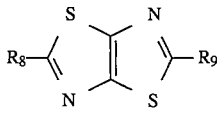

wherein $R_8$ and $R_9$ each represent

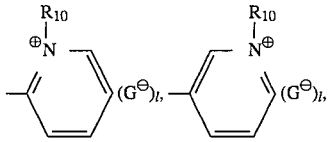

or

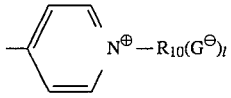

$R_{10}$ represents an alkyl group or $—(CH_2)n_8SO_3^{\ominus}$, provided that, when $R_{10}$ is $—(CH_2)n_8SO_3^{\ominus}$, l is zero and when $R_{10}$ is an alkyl group, l is 1; $G^{\ominus}$ represents an anion; and $n_8$ is an integer of 1 to 6.

Formula V

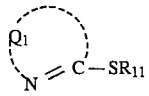

wherein $Q_1$ represents a group consisting of atoms necessary to complete a nitrogen-containing heterocyclic ring including those each condensed with a 5- or 6-membered unsaturated ring; and $R_{11}$ represents a hydrogen atom, an alkali metal atom,

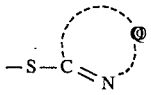

in which Q' is synonymous with $Q_1$, or an alkyl group.

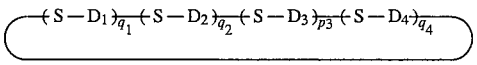

wherein $D_1$, $D_2$, $D_3$ and $D_4$ each represent a single linkage, an alkylene group having 1 to 8 carbon atoms or a vinylene group; $q_1$, $q_2$, $q_3$ and $q_4$ each represent an integer of 0, 1 or 2; and a ring formed together with a sulfur atom is further allowed to be condensed with a saturated or unsaturated 5- or 6-membered ring.

Formula VII

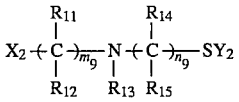

wherein $X_2$ represents —COOM', —H, —OH, $—SO_3M'$, $—CONH_2$, $—SO_2NH_2$, $—NH_2$, —SH, —CN, $—CO_2R_{16}$, $—SO_2R_{16}$, $—OR_{16}$, $—NR_{16}R_{17}$, $—SR_{16}$, $—SO_3R_{16}$, $—NHCOR_{16}$, $—NHSO_2R_{16}$, or $—COR_{16}$; $Y_2$ represents

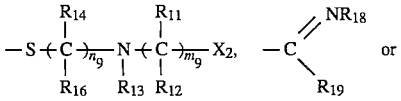

hydrogen atom; $m_9$ and $n_9$ each are an integer of from 1 to 10; $R_{11}$, $R_{12}$, $R_{13}$, $R_{14}$, $R_{15}$, $R_{17}$ and $R_{18}$ each represent a hydrogen atom, a lower alkyl group, an acyl group or

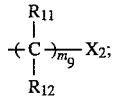

$R_{16}$ represents a lower alkyl group; $R_{19}$ represents $—NR_{20}R_{21}$, $—OR_{22}$ or $—SR_{22}$; $R_{20}$ and $R_{21}$ each represent a hydrogen atom or a lower alkyl group; and $R_{22}$ represents a group consisting of atoms necessary to complete a ring upon bonding to $R_{18}$; $R_{20}$ or $R_{11}$ is allowed to complete a ring upon bonding to $R_{18}$; and M' represents a hydrogen atom or a cation.

Formula VIII

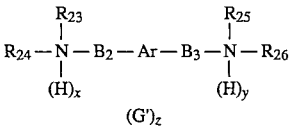

wherein Ar an arylene group or a divalent organic group completed by combining an aryl group with an oxygen atom and/or an alkylene group; $B_2$ and $B_3$ each represent a lower alkylene group; $R_{23}$, $R_{24}$, $R_{25}$ and $R_{26}$ each represent a hydroxy-substituted lower alkyl group; x and y each are an integer of 0 or 1; G' represents an anion; and z is an integer of 0, 1 or 2.

Formula IX

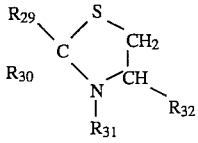

wherein $R_{29}$ and $R_{30}$ each represent a hydrogen atom, an alkyl group, an aryl group or a heterocyclic group; $R_{31}$ represents a hydrogen atom or an alkyl group: and $R_{32}$ represents a hydrogen atom or a carboxy group.

The compounds each represented by Formulas I through IX, which are preferably applicable to the invention, are generally used as a bleaching accelerator.

Typical examples of the bleaching accelerators represented by the foregoing Formulas I through IX may be given as follows. It is, however, to be understood that the invention shall not be limited thereto.

Exemplified compounds

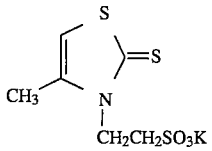
(I-1)
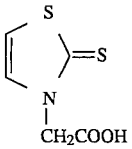
(I-2)
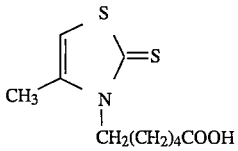
(I-3)
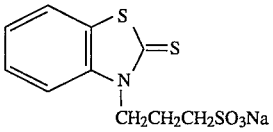
(I-4)
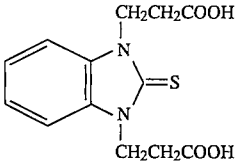
(I-5)
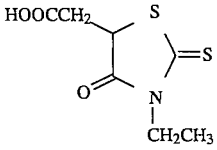
(I-6)
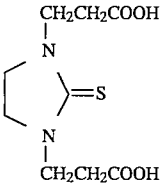
(I-7)
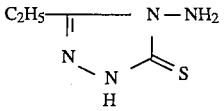
(I-8)
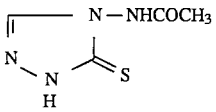
(I-9)
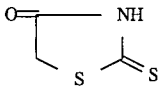
(I-10)
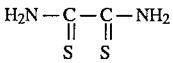
(II-1)

-continued
(II-2)
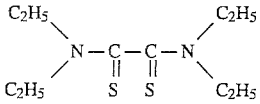
(II-3)
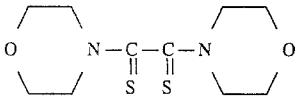
(II-4)
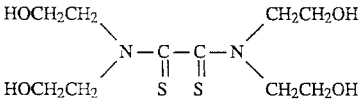
(II-5)
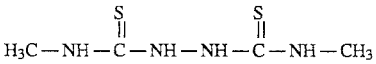
(II-6)
$H_2N-CSNHNHCS-NH_2$
(II-7)
$H_2N-CSNH(CH_2)_2NHCS-NH_2$
(II-8)
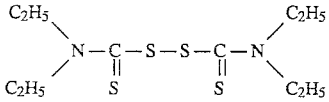
(II-9)
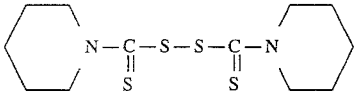
(II-10)
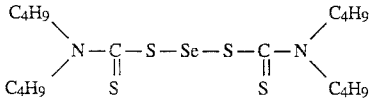
(II-11)
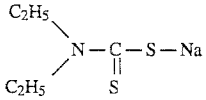
(II-12)
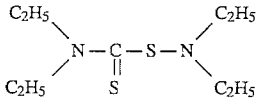
(II-13)
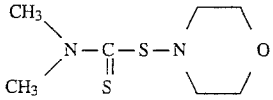
(II-14)
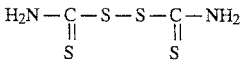
(II-15)
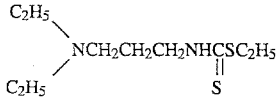
(II-16)
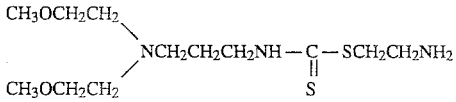
(II-17)
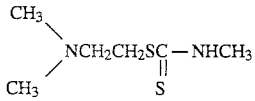

-continued
(II-18)
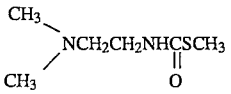
(II-19)
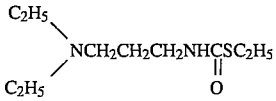
(II-20)
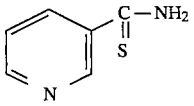
(II-21)
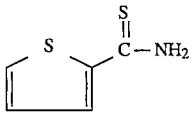
(II-22)
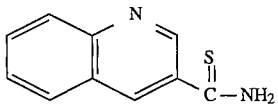
(II-23)
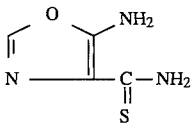
(II-24)
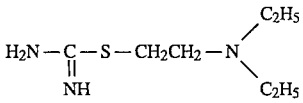
(II-25)
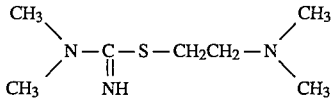
(II-26)
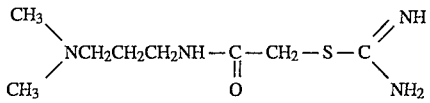
(II-27)
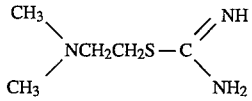
$H_2N-CH_2CH_2-SH$ (III-1)
(III-2)
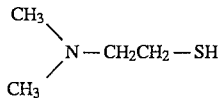
(III-3)
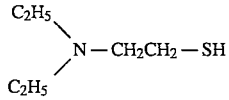
$HOOC-CH_2CH_2-SH$ (III-4)
(III-5)
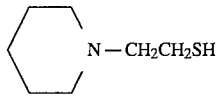

-continued
(III-6)
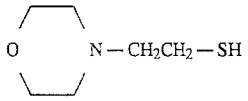
(III-7)
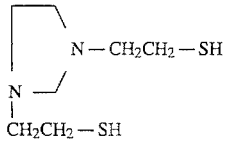
(III-8)
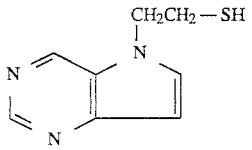
(III-9)
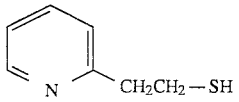
(III-10)
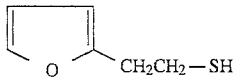
(III-11)
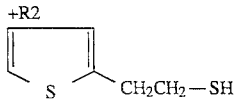
(III-12)
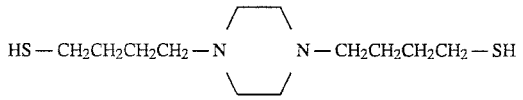
(III-13)
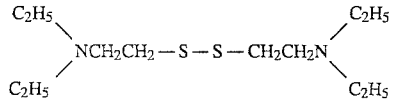
(III-14)
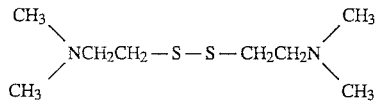
(III-15)
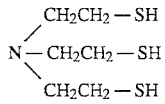
(IV-1)
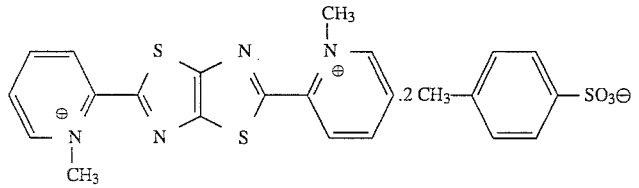
(IV-2)
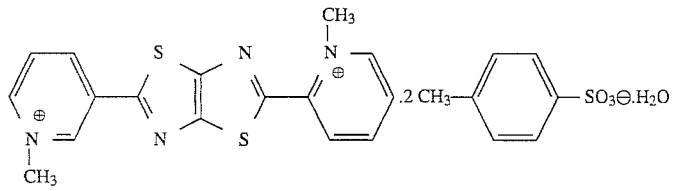

-continued
(IV-3)
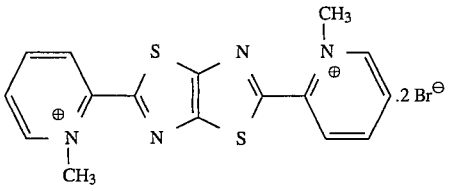
(V-1)
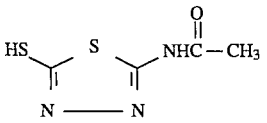
(V-2)
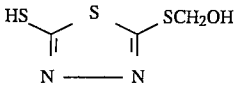
(V-3)
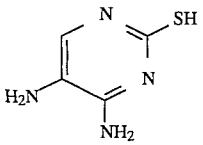
(V-4)
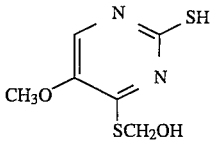
(V-5)
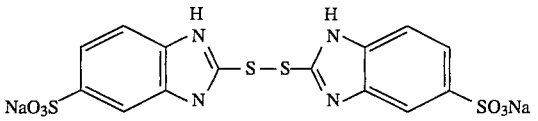
(V-6)
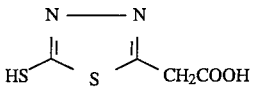
(V-7)
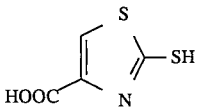
(V-8)
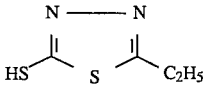
(V-9)
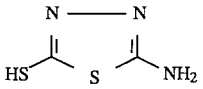
(V-10)
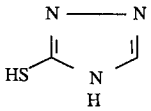
(V-11)
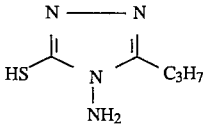

-continued
(V-12)
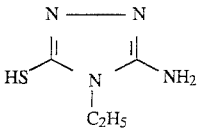
(V-13)
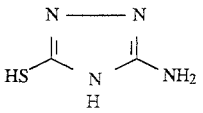
(V-14)
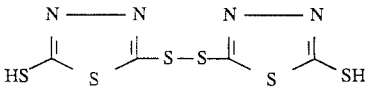
(V-15)
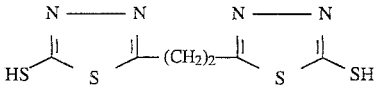
(V-16)
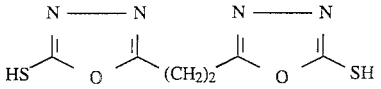
(V-17)
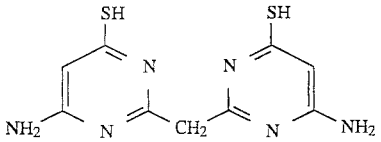
(V-18)
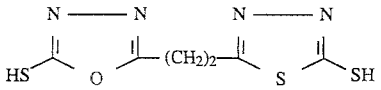
(V-19)
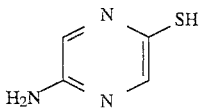
(V-20)
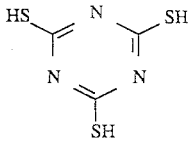
(V-21)
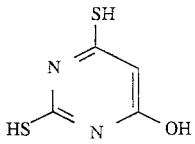
(V-22)
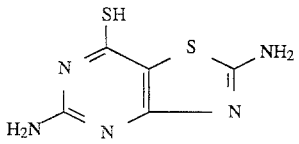
(V-23)
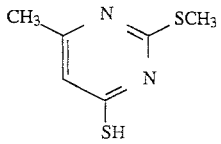

-continued
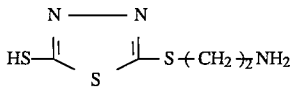
(V-24)
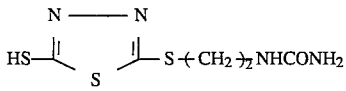
(V-25)
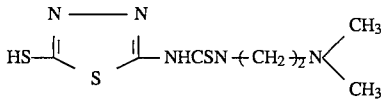
(V-26)
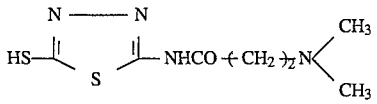
(V-27)
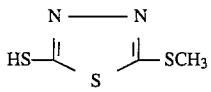
(V-28)
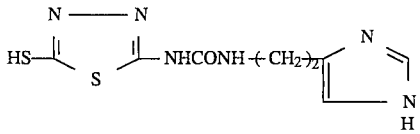
(V-29)
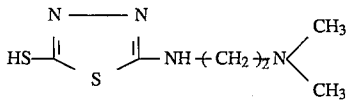
(V-30)
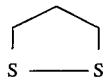
(VI-1)
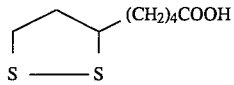
(VI-2)
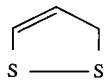
(VI-3)
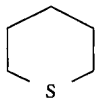
(VI-4)
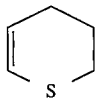
(VI-5)
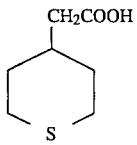
(VI-6)
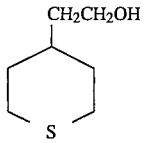
(VI-7)

-continued
(VI-8)
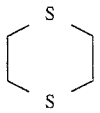
(VI-9)
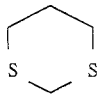
+R2
(VI-10)
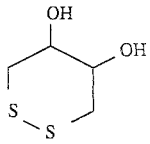
(VI-11)
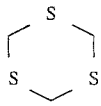
(VI-12)
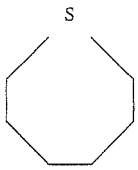
(VI-13)
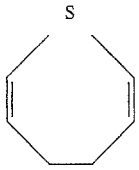
(VI-14)
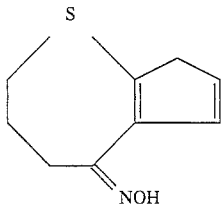
(VI-15)
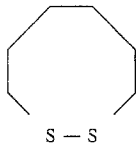
(VI-16)
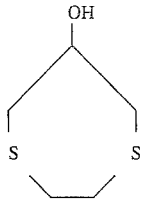

-continued
(VI-17)
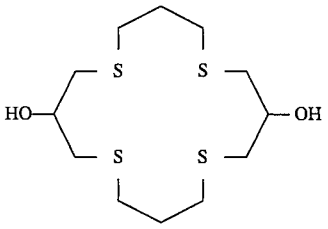
(VII-1)
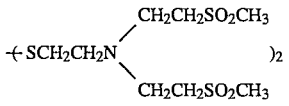
(VII-2)
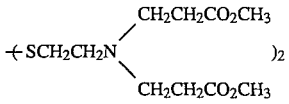
(VII-3)
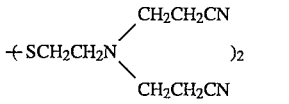
(VII-4)
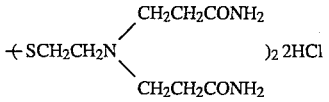
(VII-5)
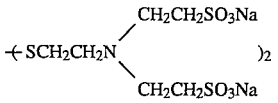
(VII-6)
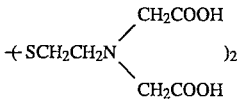
(VII-7)
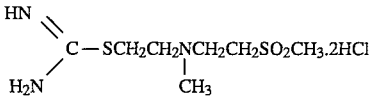
(VII-8)
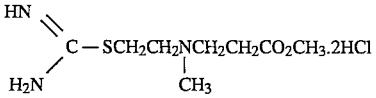
(VII-9)
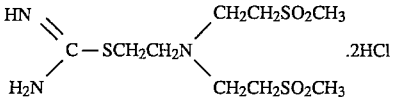
(VII-10)
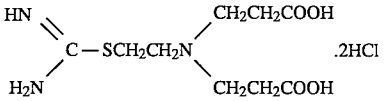
(VII-11)
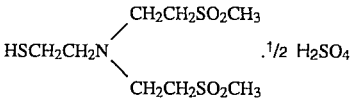
(VII-12)
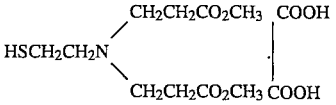

-continued
$HSCH_2CH_2N(CH_3)CH_2CH_2CONH_2$ (VII-13)
$HSCH_2CH_2NHCH_2CH_2OH$ (VII-14)
$HSCH_2CH_2N(C_2H_5)CH_2CH_2OH$ (VII-15)
VIII-1
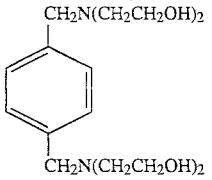
VIII-2
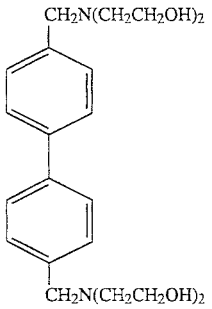
VIII-3
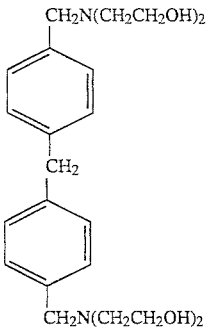
VIII-4
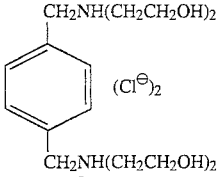
VIII-5
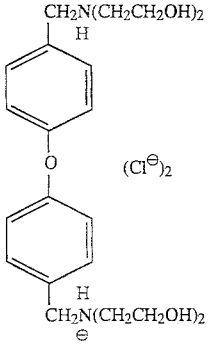

-continued
VIII-6
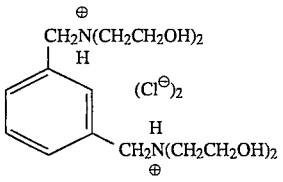
VIII-7
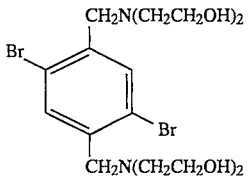
IX-1
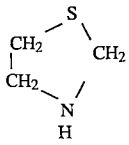
IX-2
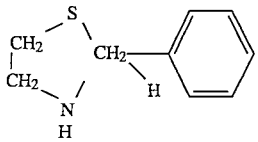
IX-3
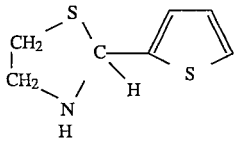
IX-4
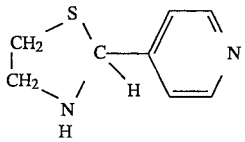
IX-5
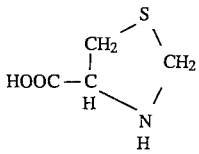
Imidazole and the derivatives thereof
A'-1
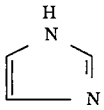
A'-2
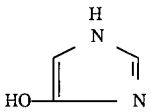
A'-3
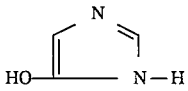
-continued
A'-4
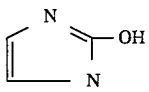
A'-5
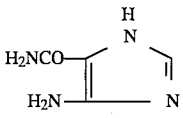

-continued

A'-6

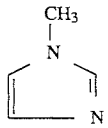

A'-7

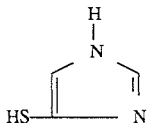

A'-8

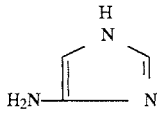

Besides the above-exemplified bleaching accelerators, for example, the following compounds may also similarly be used for.

The exemplified compounds given in Japanese Patent O.P.I. Publication No. 62-123459, pp. 51–115, such as I-2, I-4 to 7, I-9 to 13, I-16 to 21, I-23, I-24, I-26, I-27, I-30 to 36, I-38, II-2 to 5, II-7 to 10, II-12 to 20, II-22 to 25, II-27, II-29 to 33, II-35, II-36, II-38 to 41, II-43, II-45 to 55, II-57 to 60, II-62 to 64, II-67 to 71, II-73 to 79, II-81 to 84, II-86 to 99, II-101, II-102, II-104 to 110, II-112 to 119, II-121 to 124, II-126, II-128 to 144, II-146, II-148 to 155, II-157, III-4, III-6 to 8, III-10, III-11, III-13, III-15 to 18, III-20, III-22, III-23, III-25, III-27, III-29 to 32, III-35, III-36, IV-3, IV-4, V-3 to 6, V-8 to 14, V-16 to 38, V-40 to 42, V-44 to 46, V-48 to 66, V-68 to 70, V-72 to 74, V-76 to 79, V-81, V-82, V-84 to 100, V-102 to 108, V-110, V-112, V-113, V-116 to 119, V-121 to 123, V-125 to 130, V-132 to 144, V-146 to 162, V-164 to 174, V-176 to 184, VI-4, VI-7, VI-10, VI-12, VI-13, VI-16, VI-19, VI-21, VI-22, VI-25, VI-27 to 34, VI-36, VII-3, VII-6, VII-13, VII-19 and VII-20; those given in Japanese Patent O.P.I. Publication No. 63-17445, pp. 22–25, such as III-2 to 3, III-5 to 10, III-12 to 45, III-47 to 50, III-52 to 54, III-56 to 63 and III-65; and so forth.

They may be used independently or in combination and when they are generally used in an amount within the range of from about 0.01 to 100 g per liter of a bleaching solution or a bleach-fixer, an excellent result may be obtained.

The above-mentioned bleach accelerators may be used independently or in combination. Usually, a good result may be obtained when they are added in an amount within the range of about 0.01 to 100 g per liter of a bleach-fixing solution. In general, when a too small quantity is added, a bleach acceleration effect will be diminished. When a too large quantity is added, there may be some instances where a precipitation may be so produced as to contaminate a silver halide photographic light-sensitive material being processed. Therefore, they are to be added in an amount of, preferably, 0.05 to 50 g per liter of a bleach-fixing solution used and, more preferably, 0.05 to 15 g per liter of a bleach-fixing solution used.

When such bleaching accelerator is added into a bleaching solution or a bleach-fixer, it may be added as it is and then dissolved therein. It is usual to add it after dissolving it in advance in water, an alkaline solution, an organic acid or the like. If required, it may also be added therein after it is dissolved with an organic solvent such as methanol, ethanol, acetone or the like.

Such bleaching solutions may be used at a processing temperature of from 20° C. to 45° C. and, more preferably, from 5° C. to 42° C.

Such bleaching solution is usually used by adding a halide such as ammonium bromide therein.

The bleaching solutions each are also allowed to contain a pH buffer comprising a variety of salts, independently or in combination, such as boric acid, borax, sodium hydroxide, potassium hydroxide, sodium carbonate, potassium carbonate, sodium bicarbonate, potassium bicarbonate, acetic acid, sodium acetate, ammonium hydroxide and so forth. Further, the bleaching solutions are allowed to contain a variety of optical brightening agents, defoaming agents, surface active agents and antimolding agents.

When the processing solution with fixing capability is a bleach-fixer, it is preferable to use a ferric complex salt of aminocarboxylic acid or aminophosphonic acid as bleaching agent in the bleach-fixer. Said aminocarboxylic acid and aminophosphonic acid respectively mean an amino compound having at least 2 carboxyl groups and an amino compound having at least 2 phosphon groups; they are preferably represented by the following Formulae XII and XIII, respectively.

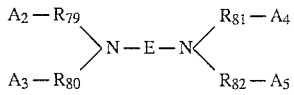

Formula XII

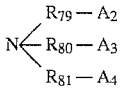

Formula XIII

In the above Formulae, E represents a substituted or unsubstituted alkylene group, cycloalkylene group, phenylene group, $—R_{83}OR_{83}OR_{83}—$, or $—R_{83}ZR_{83}—$; Z represents $=N—R_{83}—A_6$ or $=N—A_6$; $R_{79}$ through $R_{83}$ independently represent a substituted or unsubstituted alkylene group; $A_2$ through $A_6$ independently represent a hydrogen atom —OH, —COOM, or $—PO_3M_2$; M represents a hydrogen atom or alkali metal atom.

Examples of preferred compounds of Formulae XII and XIII are given below.

Example compounds (XII-1) Ethylenediaminetetraacetic acid
(XII-2) Diethylenetriaminepentaacetic acid
(XII-3) Ethylenediamine-N-(β-hydroxyethyl) -N,N',N'-triacetic acid
(XII-4) 1,3-propylenediaminetetraacetic acid
(XII-5) Triethylenetetraaminehexaacetic acid
(XII-6) Cyclohexanediaminetetraacetic acid
(XII-7) 1,2-diaminopropanetetraacetic acid
(XII-8) 1,3-diaminopropan-2-ol-tetraacetic acid
(XII-9) Ethyl ether diaminetraacetic acid
(XII-10) Glycol ether diaminetetraacetic acid
(XII-11) Ethylenediaminetetrapropionic acid
(XII-12) Phenylenediaminetetraacetic acid
(XII-13) Disodium ethylenediaminetetraacetate
(XII-14) Tetratrimethylammonium ethylenediaminetetraacetate
(XII-15) Tetrasodium ethylenediaminetetraacetate
(XII-16) Pentasodium diethylenetriaminepentaacetate
(XII-17) Sodium ethylenediamine-N-(β-hydroxyethyl)-N,N',N'-triacetate
(XII-18) Sodium propylenediaminetetraacetate
(XII-19) Ethylenediaminetetramethylenephosphonic acid
(XII-20) Sodium cyclohexanediaminetetraacetate
(XII-21) Diethylenetriaminepentamethylenephosphonic acid
(XII-22) Cyclohexanediaminetetramethylenephosphonic acid (XIII-1) Nitrilotriacetic acid
(XIII-2) Methyliminodiacetic acid
(XIII-3) Hydroxyethyliminodiacetic acid
(XIII-4) Nitrilotripropionic acid
(XIII-5) Nitrilotrimethylenephosphonic acid
(XIII-6) Iminodimethylenephosphonic acid
(XIII-7) Hydroxyethyliminodimethylenephosphonic acid
(XIII-8) Trisodium nitrilotriacetate Of these aminocarboxylic acids and aminophosphonic acids, XII-1, XII-2, XII-4, XII-6, XII-7, XII-10, XII-19, XIII-1, and XIII-5 are especially preferable for the desired effect of the present invention; particularly, XII-4 is still more preferable.

The above-mentioned ferric complex salts of organic acids of the present invention are used in the form of free acids, alkali metal salts such as sodium salts, potassium salts and lithium salts, ammonium salts, or water-soluble amine salts such as triethanolamine salts; potassium salts, sodium salts, and ammonium salts are preferably used. These ferric complex salts may be used singly or in combination. Any amount of use may be chosen according to the silver content, silver halide composition etc. of the light-sensitive material to be processed; for example, these salts can be used at more than 0.01 mol per 1 bleach-fixer, preferably 0.05 to 1.0 mol. When these salts are used in replenishers, it is desirable to use them at the upper limit of solubility to minimize the amount of replenishment.

The bleaching solution relating to the invention is to be replenished in an amount of, preferably, 20 to 500 ml per sq. meter of a silver halide color photographic light-sensitive material used, more preferably, 30 to 350 ml, further preferably, 40 to 300 ml, and, most preferably, 50 to 250 ml.

The so-called fixing agents should inevitably need the fixing solutions and the bleach-fixing solutions each relating to the invention.

The typical examples of the thiocyanates each relating to the invention include ammonium thiocyanate, potassium thiocyanate, sodium thiocyanate and so forth. The typical examples of the iodides each relating to the invention include ammonium iodide, potassium iodide, sodium iodide and so forth.

It is also allowed to use the above-mentioned fixing agents upon mixing together with thosulfates such as ammonium thiosulfate which is ordinarily used or with the above-mentioned thiocyanates and iodides each relating to the invention.

In this invention, it is necessary that a total mole number of the thiocyanates and iodides each relating to the invention should be not less than 0.5 mol/liter. When an amount added is less than 0.5 mol/liter, the effects of the objects of the invention cannot be displayed. When it is within the range of 0.7 to 6 mol/liter, more preferably, 1 to 5 mol/liter and, most preferably, 2 to 4 mol/liter, the effects of the objects of the invention can excellently be displayed.

The above-mentioned fixing solutions and bleach-fixing solutions are further allowed to contain, besides the above-mentioned fixing agents, one or more kinds of pH buffers comprising various salts including, for example, boric acid, borax, sodium hydroxide, potassium hydroxide, sodium carbonate, potassium carbonate, sodium bicarbonate, potassium bicarbonate, acetic acid, sodium acetate, ammonium hydroxide and so forth.

It is also desirable to add a large amount of alkali halides or ammonium halides including, for example, rehalogenizers such as potassium bromide, sodium bromide, sodium chloride, ammonium bromide and so forth. It is further allowed to selectively add pH buffers such as borate, oxalate, acetate, carbonate, phosphate and so forth, and the well-known additives which are usually added to fixing solutions and bleach-fixing solutions, such as alkylamines, polyethylene oxides and so forth.

In the present invention, air or oxygen blowing may be conducted in the processing bath and replenisher storage tank, or a suitable oxidizing agent, such as hydrogen peroxide, bromate or persulfate may be added to increase bleacher or bleach-fixer activities.

In the method of the present invention, silver may be recovered from the fixer or bleach-fixer by a known method. Examples of methods which serve well for this purpose include the electrolysis method of French Patent No. 2,299,667, precipitation method of Japanese Patent Publication Open to Public Inspection No. 73037/1977, West German Patent No. 2,311,220, ion exchange method of Japanese Patent Publication Open to Public Inspection No. 17114/1976, West Germany Patent No. 2,548,237 and metal replacement method of British Patent No. 1,353,805.

In-line silver recovery from the tank solution is preferable, since rapid processing is facilitated, but silver may be recovered from overflow waste liquid and then regenerated.

The desired effect of the invention is enhanced when the fixer or bleach-fixer of the invention is replenished at less than 800 ml per $m^2$ light-sensitive material; a noticeable effect is obtained at 20 to 650 ml, particularly 30 to 400 ml per $m^2$ light-sensitive material.

A processing solution having a fixing capability, such as a fixer or bleach-fixer, should preferably contain a compound represented by the following Formula FA. When using a fixer or bleach-fixer containing the compound, there is an additional effect that very little sludge is produced in occasionally processing a small quantity of light-sensitive material in the course of a long period of time.

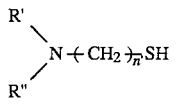

Formula FA wherein R' and R each represent a hydrogen atom, an alkyl group, an aryl group, an aralkyl group or a nitrogen-containing heterocyclic ring; and n' is an integer of 2 or 3.

The compounds represented by the above-given Formula FA will be typically exemplified.

| No. | R' | R" | n' |
|---|---|---|---|
| FA-1 | iso-$C_3H_7$— | H | 2 |
| FA-2 | n-$C_4H_9$— | H | 2 |
| FA-3 | iso-$C_4H_9$— | H | 2 |
| FA-4 | sec-$C_4H_9$— | H | 2 |
| FA-5 | ter-$C_4H_9$— | H | 2 |
| FA-6 | $CHCHCH_2$— | H | 2 |
| FA-7 | n-$C_4H_{13}$— | H | 2 |
| FA-8 | n-$C_8H_{17}$— | H | 2 |
| FA-9 | n-$C_{10}H_{21}$— | H | 2 |
| FA-10 | 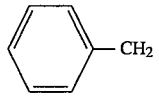 | H | 2 |
| FA-11 | 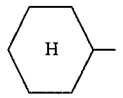 | H | 2 |

-continued

| No. | R' | R" | n' |
|---|---|---|---|
| FA-12 | $C_2H_5-$ | $C_2H_5-$ | 2 |
| FA-13 | n-$C_3H_7-$ | n-$C_3H_7-$ | 2 |
| FA-14 | iso-$C_3H_7-$ | iso-$C_3H_7-$ | 2 |
| FA-15 | n-$C_4H_9-$ | n-$C_4H_9-$ | 2 |
| FA-16 | iso-$C_4H_9-$ | iso-$C_4H_9-$ | 2 |
| FA-17 | sec-$C_4H_9-$ | sec-$C_4H_9-$ | 2 |
| FA-18 | n-$C_5H_{11}-$ | n-$C_5H_{11}-$ | 2 |
| FA-19 | iso-$C_5H_{11}-$ | iso-$C_5H_{11}-$ | 2 |
| FA-20 | $CH_{2CH}-CH_2-$ | $CH_{2CHCH_2}-$ | 2 |
| FA-21 | $CH_3-$ | $CH_3-$ | 2 |
| FA-22 | $HOCH_2CH_2-$ | $H-$ | 2 |
| FA-23 | $HOCH_2CH_2-$ | $CH_3-$ | 2 |
| FA-24 | 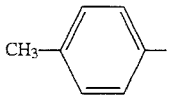 | $H-$ | 2 |
| FA-25 | 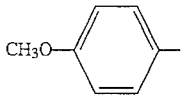 | $H-$ | 2 |
| FA-26 | 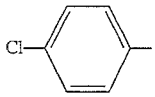 | $H-$ | 2 |
| FA-27 | $C_2H_5-$ | $CH_3-$ | 2 |
| FA-28 | $C_2H_5-$ | $C_3H_7-$ | 2 |
| FA-29 | $H-$ | $H-$ | 2 |
| FA-30 | $CH_{2CH}-CH_2-$ | $C_2H_5-$ | 2 |
| FA-31 | 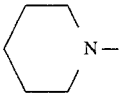 | | 2 |
| FA-32 | 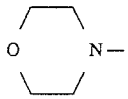 | | 2 |
| FA-33 | 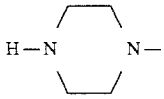 | | 2 |
| FA-34 | 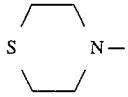 | | 2 |
| FA-35 | 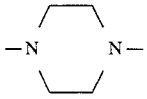 | | 2 |
| FA-36 | 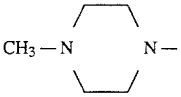 | | 2 |
| FA-37 | $C_2H_2-$ | $C_2H_5-$ | 3 |
| FA-38 | $HSCH_2CH_2-$ | $HSCH_2CH_2-$ | 2 |
| FA-39 | $HSCH_2CH_2-$ | $HOOC-CH_2-$ | 2 |

Those compounds represented by Formula FA may be synthesized in ordinary methods such as those described in, for example, U.S. Pat. Nos. 3,335,161 and 3,160,718.

The above-mentioned compounds represented by the foregoing Formula FA may be used independently or in combination.

The compounds represented by Formula FA may be added in an amount within the range of 0.1 to 200 g per liter of a processing solution used so that a good result may be obtained. In particular they may be added in an amount within the range, preferably, 0.2 to 100 g and, more preferably, 0.5 to 50 g.

The bleaching solutions of the invention may be used at a pH within the range of 2 to 8 and, in particular from the viewpoint of the effects of the invention, within the range of 2 to 5.5.

The fixing solutions and bleach-fixing solutions each of the invention may be used at a pH within the range of 4 to 8.

The fixer and bleach-fixer of the present invention may contain sulfites and sulfite-releasing compounds; examples of the sulfite and the sulfite-releasing compounds include potassium sulfite, sodium sulfite, ammonium sulfite, ammonium hydrogensulfite, potassium hydrogensulfite, sodium hydrogensulfite, potassium metabisulfite, sodium metabisulfite, and ammonium metabisulfite, and the compounds represented by the following Formula B-1 or B-2 are also included.

Formula B-1

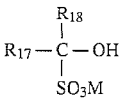

Formula B-2

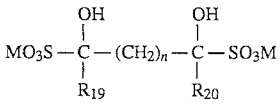

In these Formulae, $R_{17}$ represents a hydrogen atom or alkyl group having 1 to 5 carbon atoms; $R_{18}$ represents an alkyl group having 1 to 5 carbon atoms which includes substituted ones; M represent an alkalimetal atom; R19 and $R_{20}$ independently represent a hydrogen atom or alkyl group having 1 to 5 carbon atoms which includes substituted ones; n represents the integer 0 to 4.

Examples of the compounds of the above Formulae are given below, but the present invention is not limited by these examples.

Preferable compounds of Formulae B-1 and B-2 are exemplified below.

(B-1) Formaldehyde sodium bisulfite
(B-2) Acetaldehyde sodium bisulfite
(B-3) Propionaldehyde sodium bisulfite
(B-4) Butylaldehyde sodium bisulfite
(B-5) Succinic aldehyde sodium bisulfite
(B-6) Glutaraldehyde sodium bisbisulfite
(B-7) β-methylglutaraldehyde sodium bisbisulfite
(B-8) Maleic dialdehyde sodium bisbisulfite It is preferable to use these bisulfites and bisulfite-releasing compounds at ratios of at least 0.1 mol, as calculated as sulfite, per 1 fixer or bleach-fixer, preferably 0.12 to 0.65 mol/l, more preferably 0.15 to 0.50 mol/l, still more preferably 0.20 to 0.40 mol/l. The above-given mol numbers of sulfite of sulfite-releasing compound is mentioned in terms of mol numbers of sulfite.

It is preferable that total processing time for the bleaching solution and the solution with fixing capability, such as fixer or bleach-fixer, of the present invention be not more than 3 min 45 sec, more preferably 20 sec to 3 min 20 sec, still more preferably 40 sec to 3 min, most preferably 60 sec to 2 min 40 sec for the desired effect of the invention.

Bleaching time can be arbitrarily chosen in the above range of total time; for the desired purpose of the invention, it is preferable that bleaching time be not more than 1 min 30 sec, more preferably 10 to 70 sec, still more preferably 20 to 55 sec. Processing time for the processing solution with fixing capability can be arbitrarily chosen in the above range of total time; it is preferable that the processing time be not more than 3 min 10 sec, more preferably 10 sec to 2 min 40 sec, still more preferably 20 sec to 2 min 10 sec.

In the processing method of the present invention, it is preferable to conduct forced agitation of the bleaching solution, fixer and bleach-fixer. This is not only because the desired effect of the invention is enhanced but also because rapid processing is facilitated.

Here, forced agitation does not imply ordinary diffusive migration of solution but the use of a method of agitation to forcedly agitate the solution.

The methods off forced agitation which can be used are as follows:

1. High pressure spraying method or spray agitation method
2. Air bubbling method
3. Ultrasonic oscillation method
4. Vibration method In-the high pressure spraying method, the processing solution is sprayed directly to the light-sensitive material via a spray nozzle at a discharge pressure of not less than 0.1 $Kg/cm^2$ in the processing solution. In the spray agitation method, the processing solution is sprayed via a spray nozzle at a discharge pressure of not less than $0.1Kg/cm^2$ in the processing solution for agitating the solution. In these methods, a pressure pump or flow supply pump is normally used as pressure source pressure pumps include plunger pumps, gear pumps, magnet pumps, and cascade pumps; example of available products include models manufactured by Maruyama Seisakushyo, such as 15-LPM, 10-BFM, 20-BFM, AND 25-BFM.

Examples of flow supply pumps include models manufactured by Iwaki K.K., such as MD-30, MD-56, MDK-25; and MDK-32.

Nozzles and spray nozzles are available in various types, including the straight spray type, fan type, round type, entire surface type, and circular type; the effect is enhanced with the increase in impact force and thus with the increase in the number of microvibrations in the subject light-sensitive material. Spray impact force depends mainly on flow rate (l/min.) and spray pressure ($kg/c^2$; therefore, a pressurizer is needed which permits pressure regulation in proportion to the number of spray nozzles to maximize the effect. The ideal pressure is 0.3 to 10 $kg/cm^2$; smaller pressure values give no effect, while greater pressure values may cause damages or ruptures in the light-sensitive material.

In the air bubbling method, a sparger is placed at the bottom of the lower transport roller of the processing solution tank, and air or inert gas is supplied to the sparger; the light-sensitive material is vibrated by bubbles discharged from the sparger outlet and the processing solution is thus brought into efficient contact with the top, back, and side surfaces of the light-sensitive material. For the sparger, anticorrosive materials are suitable, e.g. hard vinyl chloride, polyethylene-coated stainless steel, and sintered metals. The outlet is made to have a diameter such that the discharged bubbles are 2 to 30 mm in size; better results are obtained when the outlet diameter is such that the discharged bubbles are 5 to 15 mm in size. Means of air supply include air compressors, e.g. Bebicon (0.4 KW, BU7TL), manufactured by Hitachi, Ltd., and air pumps, e.g. air pumps manufactured by Iwaki K.K. (Ap 220). Air flow rate must be 2 to 30 l/min. for each rack of the automatic processor; better results are obtained at 5 to 20 l/min. It is necessary to regulate the amount of air or inert gas according to the size of processing solution tank and the amount of light-sensitive material, but it is preferable that air or inert gas be supplied so that the amplitude of vibration of the light-sensitive material is 0.2 to 20 min.

In the ultrasonic oscillation method, an ultrasonic oscillator, placed at the bottom or in the side wall space of the processing solution tank of automatic developer, is used to apply ultrasonic waves to the light-sensitive material to increase developing acceleration efficiency. Ultrasonic oscillators which can be used include the magnetostrictive nickel oscillator (horn type) and magnetostrictive barium titanate oscillator (holder type), both manufactured by Cho-onpa Kogyo K.K.

Oscillator frequency is normally 5 to 1000 KHz; however, from the viewpoint of enhancement of the effect of the present invention and prevention of damages on the automatic processor, it is preferable that the frequency be 10 to 50 KHz.

As regards the application of ultrasonic waves to the light-sensitive material, it may be achieved directly or indirectly using a reflector, but direct application is preferred since ultrasonic waves attenuate in proportion to the application distance. It is recommended that application time be at least 1 second. In the case of partial application, it may be conducted whenever in the initial, middle, and last stages of processing.

In the vibration method, the light-sensitive material is vibrated between the upper and lower rollers in the processing solution tank of automatic processor to increase immersion processing efficiency. Examples of vibrators which can be normally used as vibration sources include V-2B and V-4B models, manufactured by Shinko Electric Co., Ltd. The vibrator must be fixed onto the upper portion of the immersion tank of automatic processor so that the vibrating needle is located in the back side of the light-sensitive material. It is preferable that the frequency be 100 to 10000 cycle/min; the most preferable range is from 500 to 6000 cycle/min. The amplitude of the subject light-sensitive material is 0.2 to 30 mm preferably 1 to 20 mm; smaller amplitude given no effect, while greater amlitude may damage the light-sensitive material. The number of vibrating elements varies depending on the size of the automatic processor, when a multitank processing unit is used, good results are obtained by allotting at least one element to each tank.

In the method of the invention, the bleaching process is carried out immediately after the developing process without any treatment between these processes.

Examples of preferred procedures of the processing method of the present invention are given below, but the invention is not limited thereby.

(1) Color developing→bleaching→fixing→washing
(2) Color developing→bleaching→fixing÷washing→stabilization
(3) Color developing→bleaching→fixing→stabilization
(4) Color developing→bleaching→fixing→1st stabilization→2nd stabilization
(5) Color developing→bleaching→bleach-fixing→washing
(6) Color developing→bleaching→bleach-fixing→washing→stabilization
(7) Color developing→bleaching→bleach-fixing→stabilization
(8) Color developing→bleaching→bleach-fixing→1st stabilization→2nd stabilization, subsequent 3rd stabilization, if needed Of these procedures, (3), (4), (7) and (8) are preferable; particularly, (3) and (4) are more preferable.

Another preferred mode of tile processing method of the invention is that in which partial or entire portion of overflow liquid of th color developer is flown into the bleacher; sludge formation in the bleacher is reduced when a given amount of the color developer is flown into the bleacher.

The color developer relating the present invention may contain alkali agents usually used in developers, e.g. sodium hydroxide, optassium hydroxide, ammonium hydroxide, sodium carbonate, potassium carbonate, sodium sulfate, sodium metaborate and borax, and may also contain various additives such as benzyl alcohol; alkali metal halides such as potassium bromide, potassium chloride; developing regulating agents such as citrazinic acid and preservatives such as hydroxylamine and sulfites.

Various defoaming agents, surfactants, and organic solvents such as methanol, dimethylformamide and dimethylsulfoxide may be contained as appropriate.

The developer relating the present invention usually has a pH of over 7, preferably about 9 to 13.

Also, the color developer used for the present invention may contain antioxidants such as hydroxylamine, tetronic acid, tetronimide, 2-anilinoethanol, dihydroxyacetone, aromatic secondary alcohol, hydroxamic acid, pentose or hexose, and pyrogallol-1,3-dimethylether.

In the color developer relating the present invention, various chelating agents may be used in combination as sequestering agents. Examples of such chelating agents include aminopolycarboxylic acids such as ethylenediaminetetraacetic acid and diethylenetriaminepentaacetic acid; organic phosphonic acids such as 1-hydroxyethylidene-1,1-diphosphonic acid; aminopolyphosphonic acids such as aminotri (methylenephosphonic acid) and ethylenediaminetetraphosphoric acid; oxycarbocylic acids such as citric acid and gluconic acid; phosphonocarboxylic acids such as 2-phosphonobutane-1,2,4-tricarboxylic acid; and polyphosphoric acids such as tripolyphosphoric acid and hexametaphosphoric acid.

In the present invention, the desired effect is especially enhanced when processing with a stabilizer is conducted after processing with a fixer or bleach-fixer.

The amount of stabilizer replenisher is 1 to 80 times, preferably 2 to 60 times the amount of solution transferred from the preceding bath per unit area of the color photographic light-sensitive material for picture taking; it is preferable that the preceding bath component, namely bleach-fixer or fixer, concentration of the stabilizer by less than 1/500, more preferably less than 1/1000 in the final chamber of the stabilizer tank. From the viewpoint of reduction of environmental pollution and lengthening storage life of the solution, it is preferable to compose the stabilization tank so that the concentration is 1/500 to 1/100000, more preferably 1/2000 to 1/50000.

It is preferable that the stabilization tank be composed of more than one chambers, more preferably 2 to 6 chambers.

From the viewpoint of the desired effect of the invention, particularly reduction of environmental pollution, it is preferable to provide 2 to 6 chambers for the stabilization tank and use the counter current method in which the solution is supplied to the posterion bath and overflown the solution from the preceding bath. it is especially preferable that the tank be composed of 2 or 3 chambers, more preferably 2 chambers.

The flow-in amount varies with the type of light-sensitive material, transport rate and method, and light-sensitive material surface squeezing method of automatic developing machine; in the case of color light-sensitive materials for picture taking or ordinary color roll films, the flow-in amount is usually 50 to 150 ml/m$^2$; the effect of the present invention becomes more noticeable under this condition when the amount of replenisher is 50 ml to 4.0 l/m$^2$, and it becomes still more noticeable when the amount of replenisher is 200 to 1500 ml/m$^2$.

Treatment temperature with the stabilizer is 15° to 60° C., preferably 20° to 45° C.

It is also preferable that the stabilizer of the present invention contain a chelating agent represented by any one of the following formulae [VII'] through [IX'] for improving the whiteness of the unexposed area and preventing yellow stains on dye images.

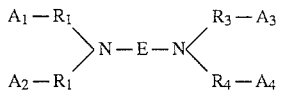

Formula [VII']

Wherein E represents an alkylene group, cycloalkylene group, phenylene group, —$R_5$—O—$R_5$—, —$R_5$—O—$R_5$—O—$R_5$—, or —$R_5$—Z—$R_5$—. Z represents

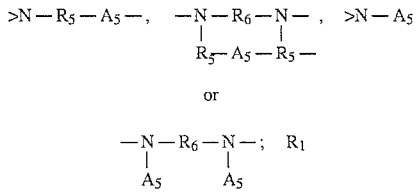

through $R_6$ independently represent an alkylene group. $A_1$ through $A_6$ independently represent —COOM or —$PO_3M_2$; $A_4$ and $A_5$ independently represent a hydrogen atom, hydroxyl group, —COOM, or —$PO_3M_2$. M represents a hydrogen atom or alkali metal atom.

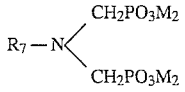

Formula [VIII']

Wherein $R_7$ represents an alkyl group, aryl group, or nitrogeneous 6-membered cyclic group; M represents a hydrogen atom or alkali metal atom.

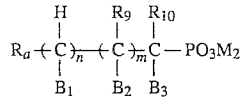

Formula [IX']

Wherein $R_8$, $R_9$, and $R_{10}$ independently represent a hydrogen atom, hydroxyl group, —COOM, —$PO_3M_2$, or alkyl group; $B_1$, $B_2$, and $B_3$ independently represent a hydrogen atom, hydroxyl group, —COOM, —$PO_3M_2$, or

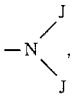

J represents a hydrogen atom, alkyl group, —$C_2H_4OH$, or —$PO_3M_2$. M represents a hydrogen atom or alkali metal atom; n and m independently represent the integer 0 or 1.

Some examples of the chelating agents represented by general formulae [VII'], [VIII'], and [IX'] will now be given below, but these are not to be construed as limitations on the choice of chelating agents for the present invention.
[Example chelating agents]
(1)
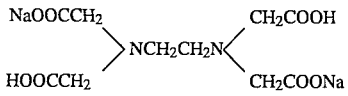
(2)
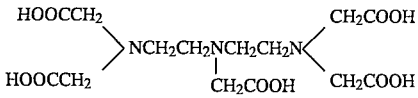
(3)
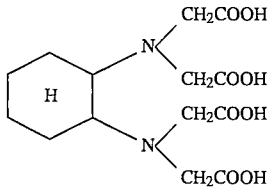
(4)
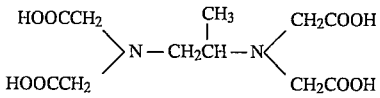
(5)
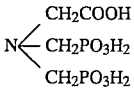
(6)
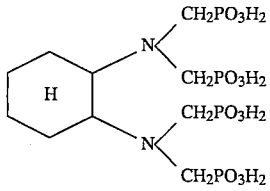
(7)
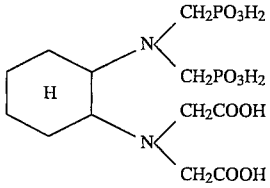
(8)
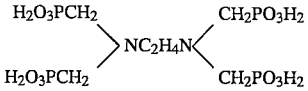
(9)
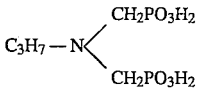
(10)
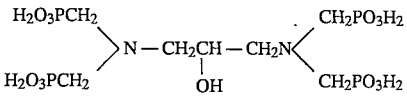
(11)
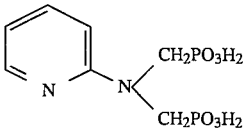
-continued
(12)
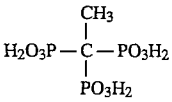
(13)
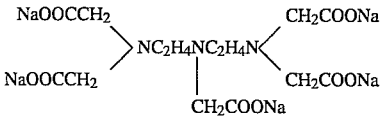
(14)
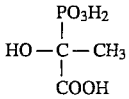
(15)
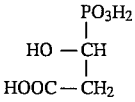
(16)
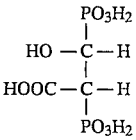
(17)
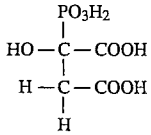
(18)
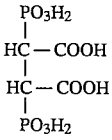
(19)
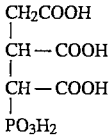
(20)
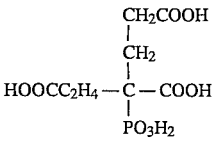
(21)
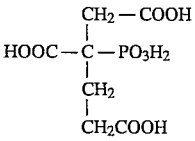
(22)
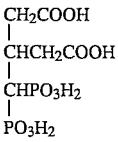
(23)
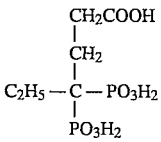

-continued (24)

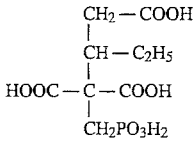

(25)

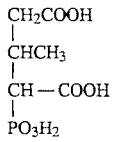

(26)

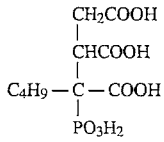

(27)

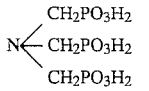

(28)

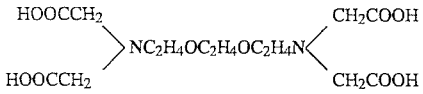

(29)

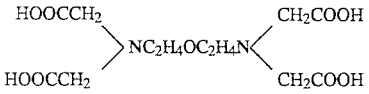

(30)

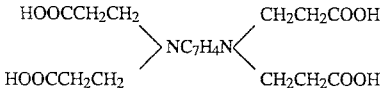

(31)

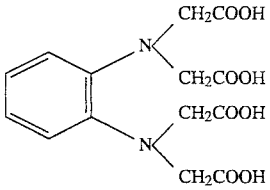

(32)

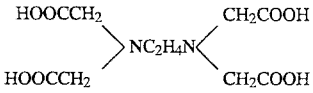

(33)

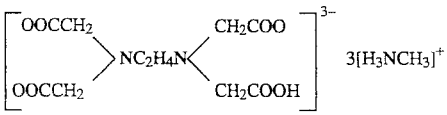

(34)

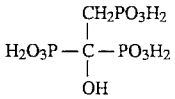

(35)

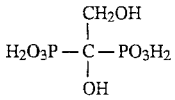

-continued (36)

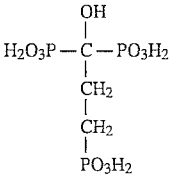

(37)

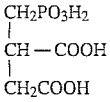

(38)

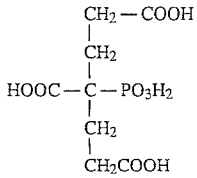

(39)

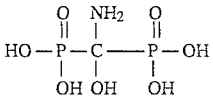

(40)

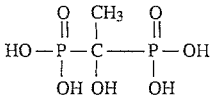

(41)

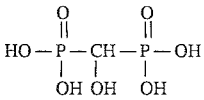

(42)

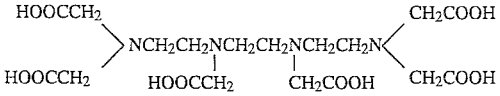

It is preferable that the preferred chelating agents be used in the stabilizing solution at ratios of 0.01 to 100 g per lit. stabilizing solution, more preferably at 0.05 to 50 g, still more preferably 0.1 to 20 g.

For the purposes of improving image preservability as well as displaying the effects of the invention, the stabilizing solutions each preferably applicable to the invention may be used at a pH within the range of, preferably, 4.0 to 9.0, more preferably, 4.5 to 9.0 and, particularly, 5.0 to 8.5.

The pH adjusting agents each capable to being added to the stabilizing solutions preferably applicable to the invention include any of generally known alkalizing agents or acidifying agent.

The stabilizing solutions preferably applicable to the invention may be added with organic acid salts including, for example, those of citric acid, acetic acid, succinic acid, oxalic acid, benzoic acid and so forth, pH adjusting agents including, for example, those of phosphates, borates, hydrochloric acid, sulfates and so forth, surfactants, antiseptics, metal salts including for example, Bi, Mg, Zn, Ni, Al, Sn, Ti, Zr and so forth. The above-given compounds may be added independently or in combination in any amount, provided that the pH of a stabilizing bath should necessarily be maintained according to the invention and any bad influence should not affect the storage stability of color photographic images and any precipitation should not be produced.

Antiseptics preferably applicable to the stabilizing solutions of the invention include, for example, a hydroxybenzoic acid ester compound, a phenol type compound, a thiazole type compound, a pyridine type compound, a guanidine type compound, a carbamate type compound, a morpholine type compound, a quaternary phosphonium type compound, an ammonium type compound, a urea type compound, an isoxazole type compound, a propanolamine type compound, a sulfamide type compound, an amino acid type compound, an active halogen releasable type compound and a benztriazole type compound.

The above-mentioned hydroxybenzoic acid ester compounds include hydroxybenzoic acid methyl ester, ethyl ester, propyl ester, and butyl ester; hydroxybenzoic acid n-butyl ester, isobutyl ester, and propyl ester are preferred; a mixture of these three hydroxybenzoic acid esters is more preferable.

The phenol compounds which can be preferably used as fungicides for the present invention may have a substituent, such as alkyl group, halogen atom, nitro group, hydroxyl group, carboxyl group, amino group, and phenyl group; the preferred are orthophenylphenol, orthocyclohexylphenol, phenol, nitrophenol, chlorophenol, cresol, guaiacol, and aminophenol. The most preferable is orthophenylphenol, which exhibits noticeable antifungal effects when used in combination with a bisbisulfite adduct of aldehyde derivative.

The thiazol compounds have a nitrogen atom and sulfur atom in the 5-membered ring; the preferred thiazol compounds are 1,2-benzisothiazolin-3-one, 2-methyl-4-isothiazolin-3-one, 2-octyl-4-isothiazolin-3-one, 5-chloro-2-methyl-4-isothiazolin- 3-one, 2-chloro-4-thiazolylbenzimidazole.

Examples of the pyridine compounds include 2,6-dimethylpyridine, 2,4,6-trimethylpyridine, and sodium-2-pyridinethiol- 1-oxide; the preferred is sodium-2-pyridinethiol-1-oxide.

Examples of the guanidine compounds include cyclohexidine, polyhexamethylene, biguanidine hydrochloride, and dodecylguanidine hydrochloride; the preferred are dodecylguanidine and its salts.

Examples of the carbamate compounds include methyl-1-(butylcarbamoyl)- 2-benzimidazole carbamate and methylimidazole carbamate.

Examples of the morpholine compounds include 4-(2-nitrobutyl)morpholine and 4-(3-nitrobutyl)morpholine.

The quaternary phosphonium compounds include tetraalkylphosphonium salts and tetraalkoxyphosphonium salts; the preferred are tetraalkylphosphonium salts; examples of more preferable compounds are tri-n-butyltetradecylphosphonium chloride and tri-phenyl.nitrophenylphosphonium chloride.

Examples of the quaternary ammonium compounds include benzalkonium salts, benzetonium salts, tetraalkylammonium salts, and alkylpyridinium salts, specifically, e.g. dodecyldimethylbenzylammonium chloride, didecyldimethylammonium chloride, and laurylpyridinium chloride.

Examples of the urea compounds include N-(3,4-dichlorophenyl)-N'-( 4-chlorophenyl)urea and N-(3-trifluoromethyl- 4-chlorophenyl)-N'-(4-chlorophenyl)urea.

Examples of the isoxazole compounds include 3-hydroxy-5-methyl-isoxazole.

The propanolamine compounds include n-propanols and isopropanols, specifically, e.g. DL-2-benzylamino-1-propanol, 3-diethylamino-1-propanol, 2-dimethylamino-2-methyl-1-propanol, 3-amino-1-propanol, isopropanolamine, diisopropanolamine, and N,N-dimethyl-isopropanolamine.

The sulfamide compounds include o-nitrobenzenesulfamide, p-aminobenzenesulfamide, 4-chloro-3,5-dinitrobenzenesulfamide, and α-amino-p-toluenesulfamide.

The amino acid compounds include N-lauryl-β-alanine.

The active halogen-releasing compounds include sodium hypochlorite, sodium dichloroisocyanurate, trichloroisocyanuric acid, chloramine T, chloramine B, dichlorodimethylhydantoin, and chlorobromodimethylhydantoin; sodium hypochlorite, sodium dichloroisocyanurate, and trichloroisocyanuric acid are preferred.

As examples of the benztriazole compounds, mention may be made to the following.

Benztriazole compounds (a)

(b)

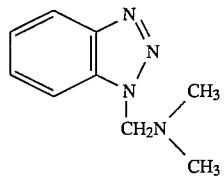

(c)

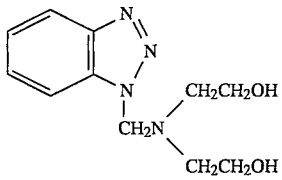

(d)

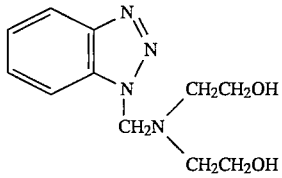

(e)

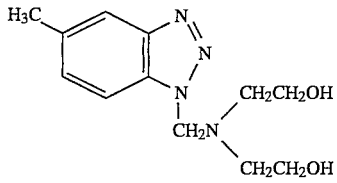

(f)

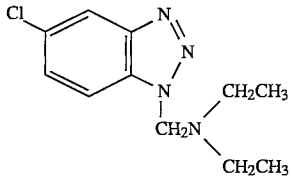

(g)

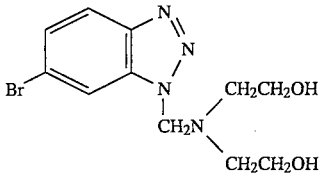

Of the above-mentioned fungicides, the preferred are phenol compounds, thiazole compounds, pyridine compounds, guanidine compounds, quaternary ammonium compounds, active halogen-releasing compounds, and benztriazole compounds. Phenol compounds, thiazole compounds, active halogen-releasing compounds, and benztriazole compounds are especially preferable for solution storability.

The desired effect of the present invention cannot be obtained when these fungicides are added in ratios of below 0.001 g per lit. stabilizing solution; ratios of over 50 g/l lead to undesirably high cost and even deterioration of dye image storage stability; the normal range is from 0.001 to 50 g, and the preferred range is 0.005 to 10 g.

From the solutions containing soluble silver salts, such as stabilizers, fixers, bleach-fixers and so forth, silver may be recovered in a variety of silver recovering methods. For example, the effectively applicable silver recovery methods include an electrolysis methods such as that described in French Patent No. 2,299,667; a precipitation method such as those described in Japanese Patent O.P.I. Publication No. 52-73037(1977) and West German Patent No. 2,331,220; an ion-exchange method described in Japanese Patent O.P.I. Publication No. 51-17114(1976) and West German Patent No. 2,548,237; a transmetallation methods such as that described in British Patent No. 1,353,805; and so forth.

Silver may be recovered through an in-line system from a tank processing solution tank. Or, the above-mentioned soluble silver salts are recovered in the above-mentioned method from the overflow of a processing solution, silver may then be recovered and the residual solution may be discarded as a waste solution. Further, the residual solution may be added with a regenerating agent so as to reuse as a replenisher or a processing solution. It is particularly preferable to recover silver after mixing a stabilizer into a fixer or a bleach-fixer.

In this case, it is also allowed to use a process of bringing a stabilizer into contact with an ion-exchange resin, an electrodialysis process and a reverse permeation process to which Japanese Patent O.P.I. Publication No. 61-28949(1986) may be referred, and so forth.

It is preferable to use deionized water for the stabilizer relating the present invention, since the antifungal property, stability and image storage property of the stabilizer are improved. Any means of deionization can be used, as long as the dielectric constant of treated water is below 50 μs/cm, or the Ca/Mg ion concentration is below 5 ppm; for example, treatment using ion exchange resin or reverse osmosis membrane is preferably used singly or in combination. Ion exchange resins and reverse osmosis membranes are described in detail in Kokai-giho No. 87-1984; it is preferable to use strongly acidic H-type cation exchange resin and strongly alkaline OH-type anion exchange resin in combination.

For enhanced washing effect, improved whiteness, and antifungal property, it is preferable that the salt concentration of the stabilizer be below 1000 ppm, more preferably below 800 ppm.

For the effect of the present invention, processing time for the stabilizer is not more than 1 min, preferably not more than 1 min 30 sec, more preferably not more than 1 min.

In the processing method of the present invention, there is no particular limitation on the halogen composition of light-sensitive material, but is preferable that the average silver iodide content of the entire silver halide emulsion be 0.1 to 15 mol %, more preferably 0.5 to 12 mol %, still more preferably 1 to 6 mol %.

Also, there is no limitation on the average grain size of the entire silver halide emulsion in the light-sensitive material, but it is preferable that the average grain size be not more than 2.0 μm, more preferably 0.1 to 1.0 μm, still more preferably 0.2 to 0.6 μm.

In the processing method of the present invention, there is a lower limit of the total dry thickness of all hydrophilic collid layers in the light-sensitive material, hereinafter referred to as the thickness of emulsion side, depending on the silver halide emulsion, couplers, oils, additives etc. contained in the layer; it is preferably that the thickness of emulsion side be 5 to 18 μm, more preferably 10 to 16 μm.

It is also preferable that the distance between the uppermost surface of the emulsion side layer and the lowermost surface of the emulsion layer nearest the support be not less than 14 μm, and the distance between the uppermost surface and the lowermost surface of the emulsion layer which is different in color sensitivity from the emulsion layer nearest the support and which is second nearest the support be not less than 10 μm.

The light-sensitive material for the present invention is of the coupler-in-emulsion type (cf. U.S. Pat. Nos. 2,376,679 and 2,801,171), in which couplers are contained in the light-sensitive material; any coupler generally known in the relevant field can be used. Examples of cyan coupler include compounds having a naphthol or phenol structure as the base structure and which form indoaniline dye via coupling. Examples of magenta coupler include compounds having a 5-pyrazolone ring with active methylene group as the skeletal structure and pyrazoloazole compounds. Examples of yellow coupler include compounds having a benzoylacetoanilide, pivalylacetoanilide or acylacetoanilide structure with an active methylene ring. In these couplers, whether a substituent is contained at the coupling site. As stated above, both 2-equivalent and 4-equivalent couplers can be used.

The couplers preferably used to enhance the desired effect of the present invention are described in detail below.

The cyan couplers are represented by the following Formulae C-A, C-B, and C-C.

Formula C-A

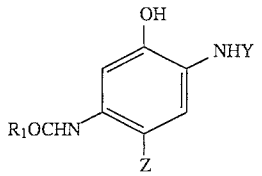

Formula C-B

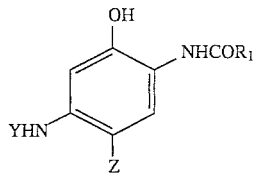

In these Formulae, $R_1$ represents an alkyl group, alkenyl group, cycloalkyo group, aryl group or heterocyclic group; Y represents a group represented by

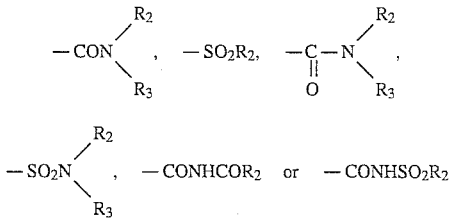

in which $R_2$ represents an alkyl group, alkenyl group, cycloalkyl group, aryl group or heterocyclic group; $R_3$ represents a hydrogen atom or group for $R_2$; $R_2$ and $R_3$ may be identical or not, and may link together to form a 5- to 6-membered heterocycle; Z represents a hydrogen atom or group capable of being split off by the coupling reaction with the oxidation product of the aromatic primary amine-type color developing agent.

Formula C-C

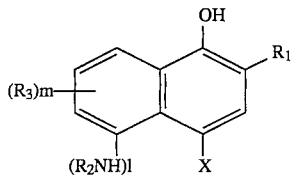

Wherein $R_1$ represents —$COHR_4R_5$, —$NHCOR_4$, —$NHCOOR_6$, —$NHSO_2R_6$, —$HNCONR_4R_5$ or —$NHSO_2NR_4R_5$; $R_2$ represents a monovalent group; $R_3$ represents a substituent; X represents a hydrogen atom or group which capable of being split off by the reaction with the oxidation product of the aromatic primary amine-type color developing agent; 1 represents an integer 0 or 1; m represents an integer 0 to 3; $R_4$ and $R_5$ independently represent a hydrogen atom, aromatic group, aliphatic group or heterocyclic group; $R_6$ represents an aromatic group, aliphatic group or heterocyclic group; when m is 2 or 3, the $R_3$ units may be identical or not, and may link together to form a ring; $R_4$ and $R_5$, $R_2$ and $R_3$, $R_2$, and X may link together to form a ring; provided that when 1 is 0, m represents 0, $R_1$ represents —$CONHR_7$, and $R_7$ represents an aromatic group.

The above Formulae C-A and C-B are first described below. In these Formulae, Y represents a group

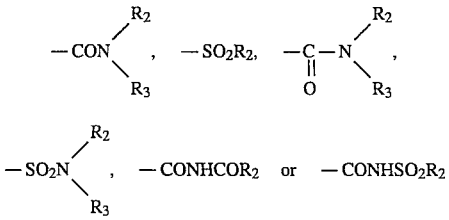

wherein $R_1$ and $R_2$ independently represent an alkyl group, preferably having 1 to 20 carbon atoms, e.g. methyl, ethyl, t-butyl, dodecyl; alkenyl group, preferably having 2 to 20 carbon atoms, e.g. aryl group, heptadecenyl group; cycloalkyl group; preferably 5- to 7-membered cycloalkyl group, e.g. cycloalkyl; aryl group, e.g. phenyl, tolyl, naphthyl; or heterocyclic group, preferably 5- or 6-membered heterocyclic group having 1 to 4 nitrogen, oxygen, or sulfur atoms, e.g. furyl, thienyl, benzothiazolyl. $R_3$ represents a hydrogen atom or group for $R_2$; $R_2$ and $R_3$ may link together to form a 5- or 6-membered heterocycle. Note that any substituent may be introduced to $R_1$ and $R_2$; examples of the substituent include alkyl groups having 1 to 10 carbon atoms, e.g. methyl, i-propyl, i-butyl, t-butyl, t-octyl; aryl groups, e.g. phenyl, naphthyl; halogen atoms, fluorine, chlorine, bormine etc.; cyano; nitro; sulfonamide groups, e.g. methanesulfonamide, butanesulfonamide, p-toluenesulfonamide; sulfamoyl groups, e.g. methylsulfamoyl, phenylsulfamoyl; sulfonyl groups, e.g. methanesulfonyl, p-toluenesulfonyl, fluorosulfonyl groups; carbamoyl groups, e.g. demethylcarbamoyl, phneylcarbamoyl; oxycarbonyl groups, e.g. ethoxycarbonyl, phenoxycarbonyl; acyl groups, e.g. acetyl, benzoyl; heterocyclic groups, e.g. pyridyl group, pyrazolyl group; alkoxy groups; aryloxy groups; and acyloxy groups.

In Formulae C-A and C-B, $R_1$ represents a balast groups essential to provide a nondiffusion property for the cyan couplers of these Formulae and cyan dyes formed therefrom, preferably an alkyl group having 4 to 30 carbon atoms, aryl group, alkeny group, cycloalkyl group or heterocyclic group; examples include normal or branched alkyl groups such as groups of t-butyl, n-octyl, t-octyl, n-dodecyl, and 5- or 6-membered heterocyclid rings.

In the above Formulae C-A and C-B, Z represents a hydrogen atom or group capable of being split off upon the coupling reaction with the oxidation product of N-hydroxyalkyl-substituted p-phenylenediamine derivative-type color developing agent. Examples include halogen atoms, e.g. chlorine, bromine, fluorine, substituted or unsubstituted alkoxy groups, aryloxy groups, heterocyclic oxy groups, acylocy groups, carbamoyloxy groups, sulfonyloxy groups, alkylthio groups, arylthio groups, heterocyclic thio groups, and sulfonamide groups; more specific examples include groups described in U.S. Pat. No. 3,741,563, Japanese Patent Examine Publication No. 48-36894/1973, Japanese Patent Publication Open to Public Inspection Nos. 47-37425/1972, 50-10135/1975, 50-117422/1975, 50-13044/1975, 51-108841/1976, 50-120343/1975, 52-18315/1977, 53-105226/1978, 54-14736/1979, 54-48237/1979, 55-32071/1980, 55-65957/1980, 56-1938/1981, 56-12643/1981, 56-27147/1981, 59-146050/1984, 59-166956/1984, 60-24547/1985, 60-35731/1985, and 60-37557/1985. The cyan couplers represented by Formula C-D are preferable for the present invention.

Formula C-D

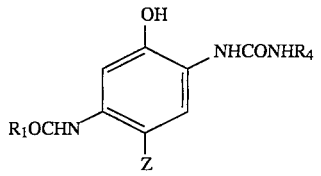

Wherein $R_4$ represents a substituted or unsubstituted aryl group, preferably a phenyl group. The substituent for the aryl group includes —$SO_2R_5$, halogen atoms such as fluorine, chlorine, bromine; —$CF_3$, —$NO_2$, —CN, —$COR_5$, —$COOR_5$, —$SO_2OR_5$,

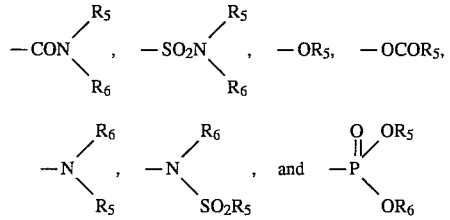

Wherein $R_5$ represents an alkyl group, preferably having 1 to 20 carbon atoms, e.g. methyl, ethyl, t-butyl, dodecyl; alkenyl group, preferably having 2 to 20 carbon atoms, e.g. allyl group, heptadecenyl group; cycloalkyl group, preferably having 5- to 7-member, e.g. cyclohexyl group; or aryl groups, e.g. phenyl group, tolyl group, naphthyl group; $R_6$ represents a hydrogen atom or group for $R_5$.

The compounds of Formula C-D preferred for cyan couplers for the present invention have a substituted or unsubstituted phenyl group for $R_4$, and the substituent in the phenyl group is cyano, nitro, —$SO_2R_7$, $R_7$ represents an alkyl group, halogen atom, or trifluoromethyl.

In Formula C-D, Z and $R_1$ each have the same definition as in Formulae C-A and C-B. The balast groups preferable for $R_1$ are represented by the following Formula Formula C-E

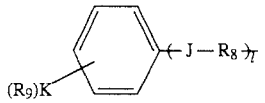

Formula C-E

Wherein J represents an oxygen atom, sulfur atom or sulfonyl group; k represents the integer 0 to 4; 1 represents 0 or 1; when k is 2 or more, the $R_9$ units may be identical or not; $R_8$ represents a normal or branched alkylene group having 1 to 20 carbon atoms which may have aryl group etc. as a substituent; $R_9$ represents a monovalent group, preferably a hydrogen atom, halogen atom, e.g. chlorine, bromide; alkyl group, preferably a normal or branched alkyl group having 1 to 20 carbon atoms, e.g. methyl, t-butyl, t-pentyl, t-octyl, dodecyl, pentadecyl, benzyl, phenetyl; aryl group, e.g. phenyl group; heterocyclic group, e.g. nitrogen-containing heterocyclic group; alkocy group, preferably normal or branched alkoxy group having 1 to 20 carbon atoms, e.g. methoxy, ethyoxy, t-butyloxy, octyloxy, decyloxy, dodecyloxy; aryloxy group, e.g. phenoxy group; hydroxy group; acyloxy group; preferably alkylcarbonyloxy group, arylcarbonyloxy group, e.g. acetoxy group, benzoloxy group; carboxyl alkyloxycarbonyl group, normal or branched alkylcarbonyl group preferably having 1 to 20 carbon atoms, preferably phenoxycarbonyl group; alkylthio group; acyl group preferably having 1 to 20 carbon atoms; acylamino group, normal or branched alkylcarbamide group preferably having 1 to 20 carbon atoms; benzenecarbamide group; sulfonamide group, preferably normal or branched alkylsulfonamide or benzenesulfonamide group having 1 to 20 carbon atoms; carbamoyl group; normal or branched alkylaminocarbonyl or phenylaminocarbonyl group preferably having 1 to 20 carbon atoms; sulfamoyl group; normal or branched alkylmainosulfonyl or phenylaminosulfonyl group preferably having 1 to 20 carbon atoms.

Typical examples of the cyan couplers represented by Formula C-A and C-B may be given as follows. It is, however, to be understood that the investigation sall not be limited thereto.

[Exemplified Compounds]

C-1
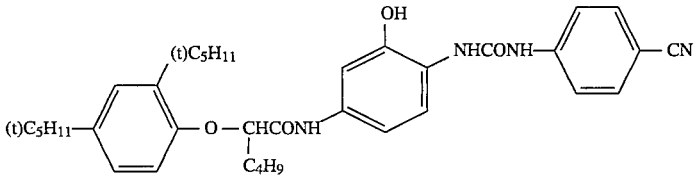
C-2
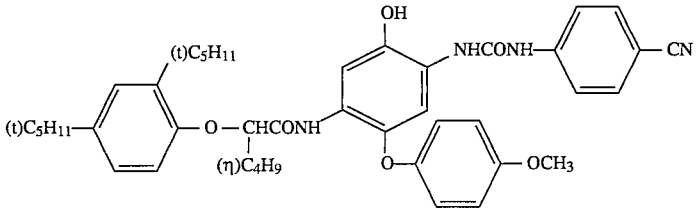
C-3
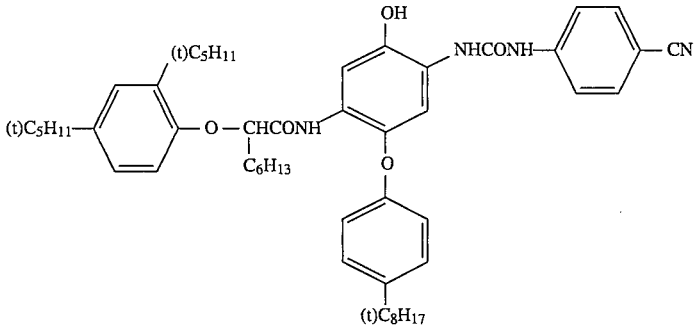
C-4
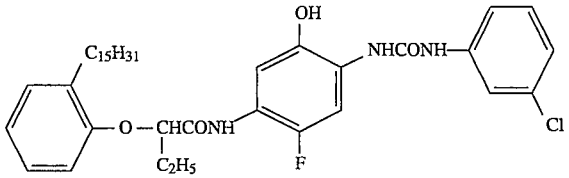
C-5
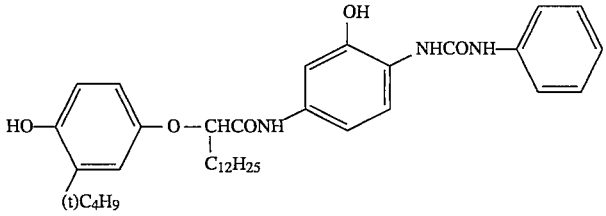
C-6
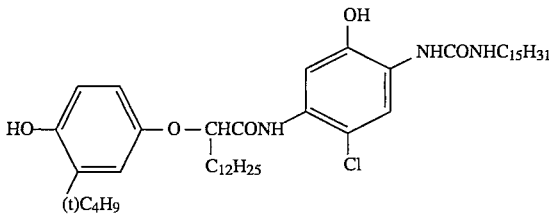
C-7
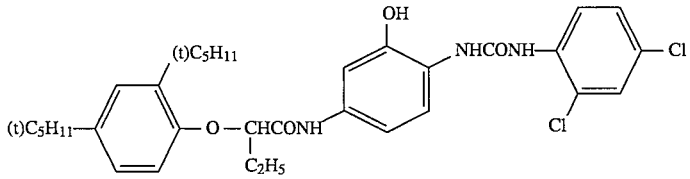

-continued
C-8
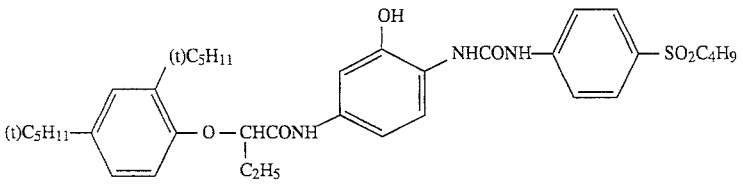
C-9
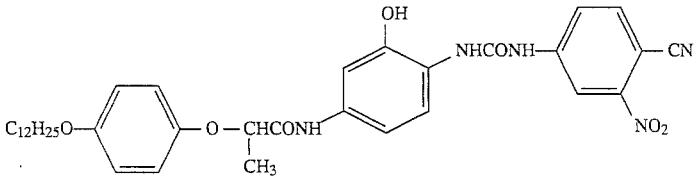
C-10
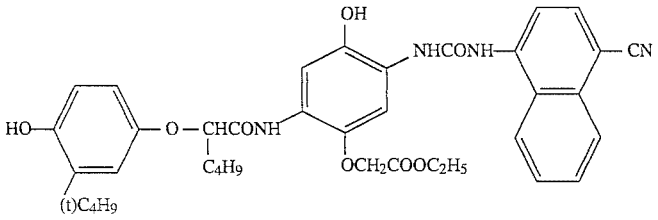
C-11
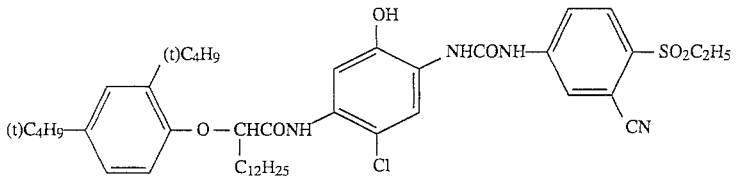
C-12
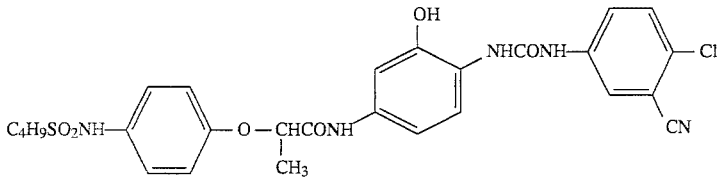
C-13
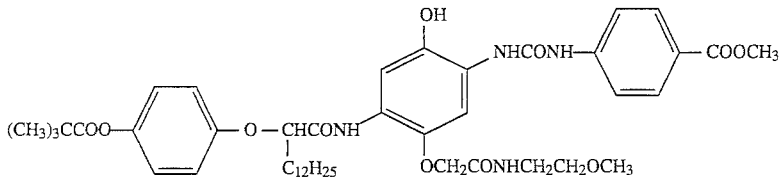
C-14
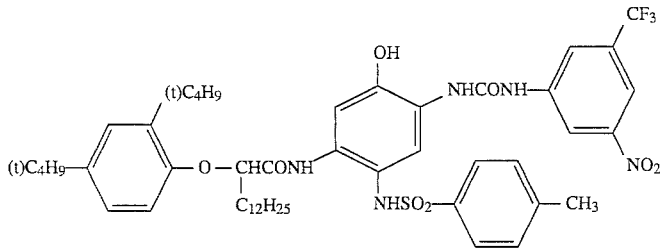
C-15
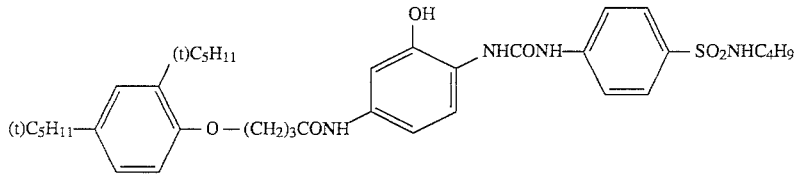

-continued
C-16
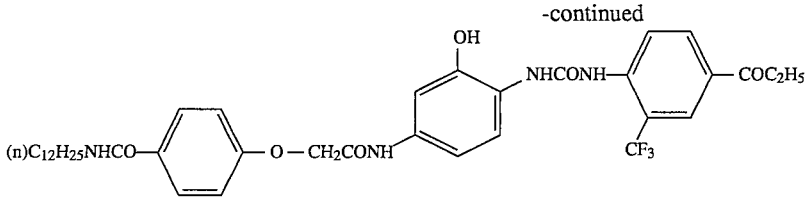
C-17
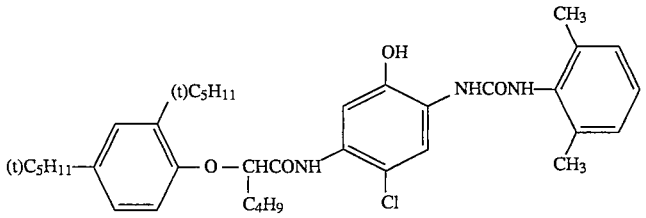
C-18
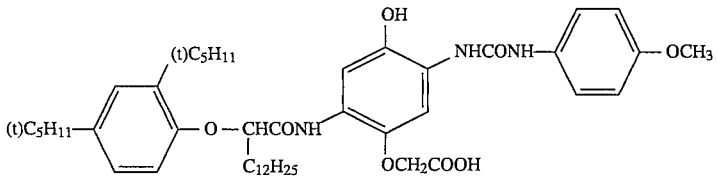
C-19
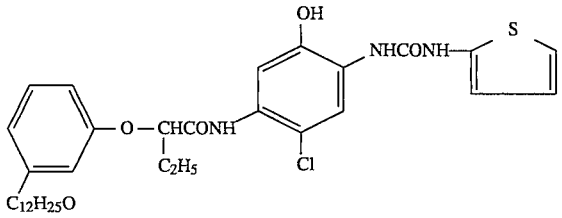
C-20
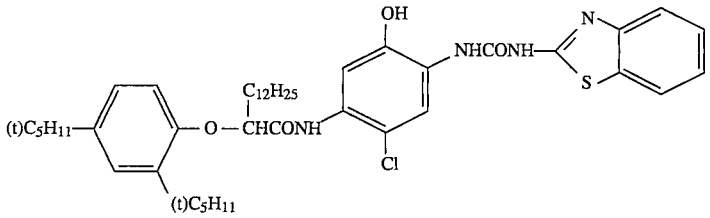
C-21
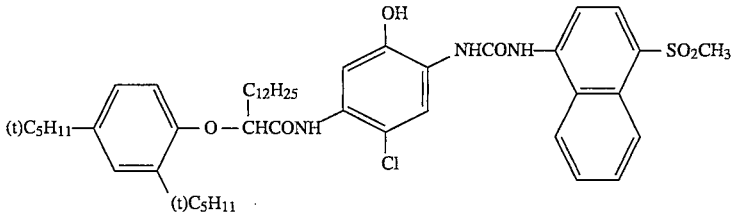
C-22
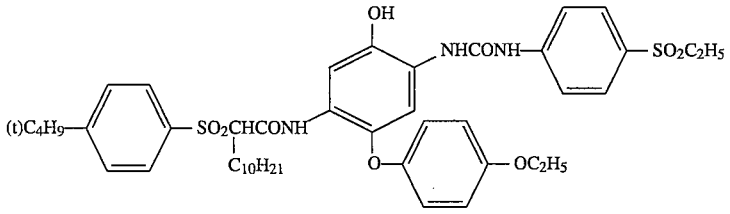

-continued
C-23
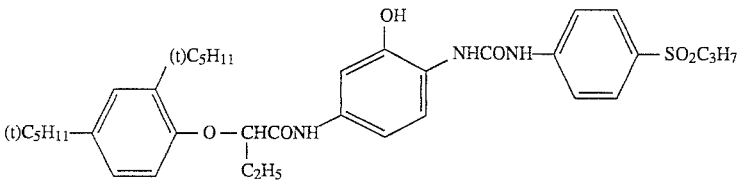
C-24
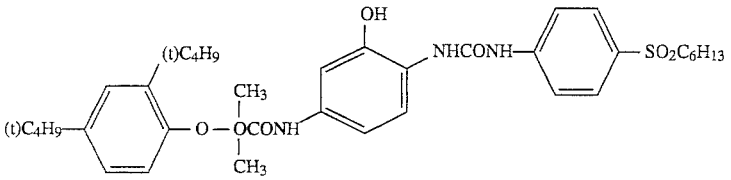
C-25
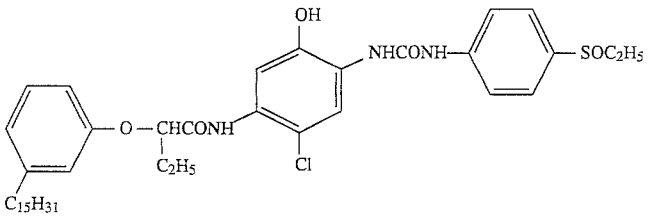
C-26
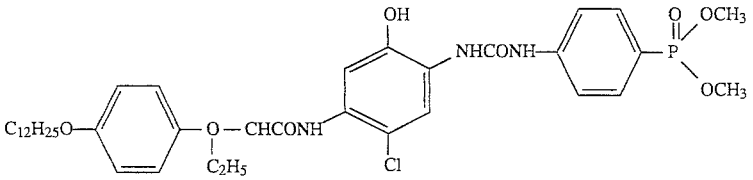
C-27
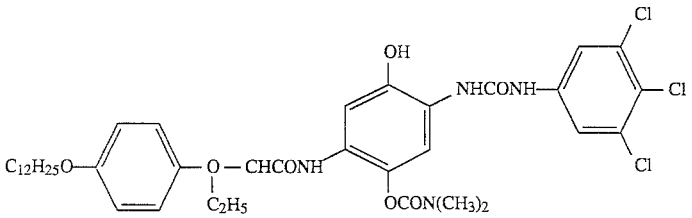
C-28
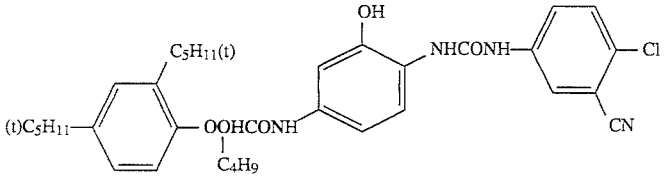
C-29
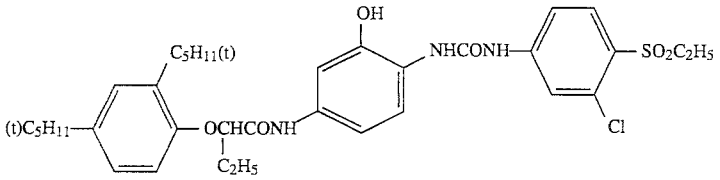
C-30
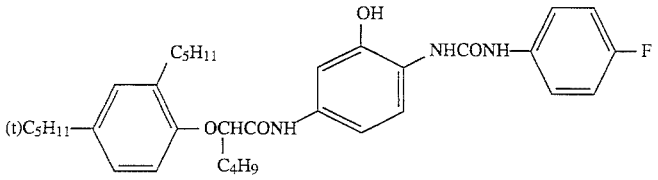

-continued
C-31
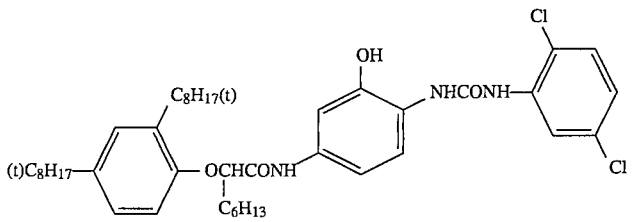
C-32
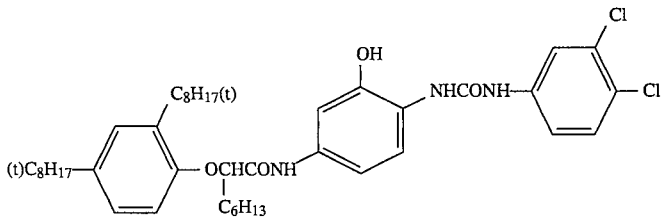
C-33
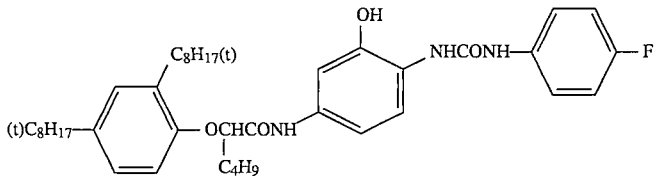
C-34
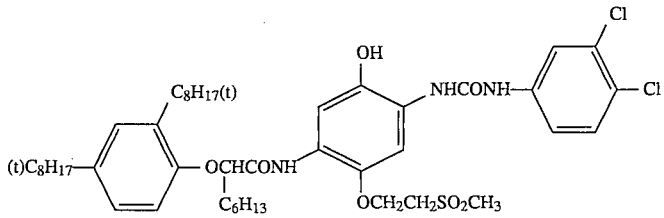
C-35
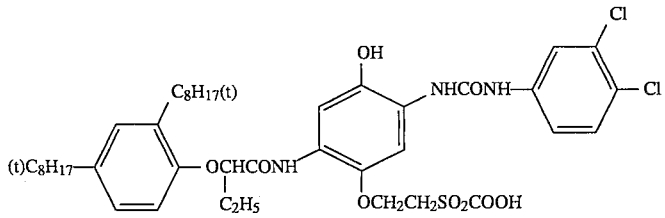
C-36
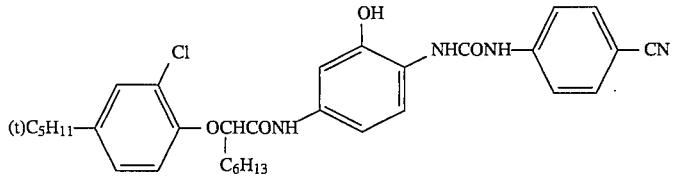
C-37
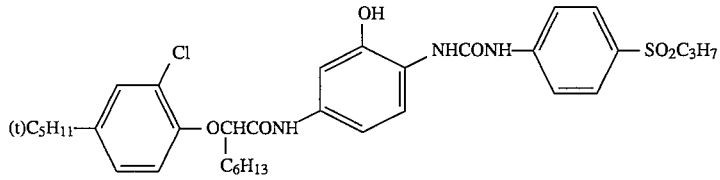
C-38
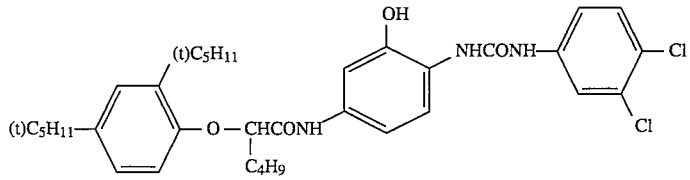

-continued
C-39
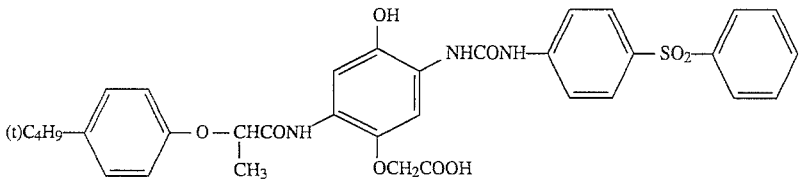
C-40
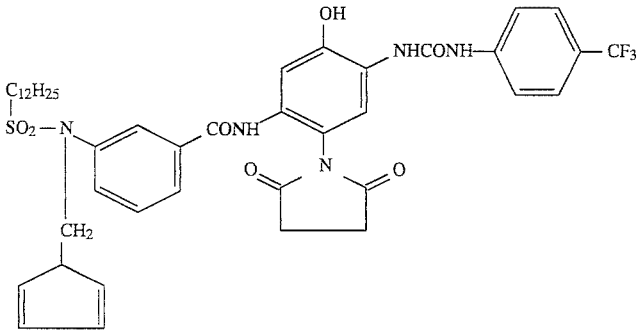
C-41
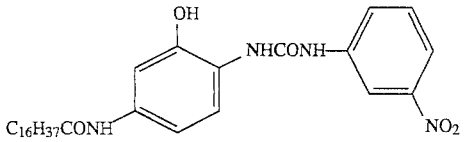
C-42
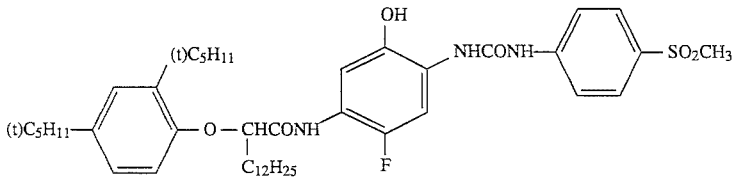
C-43
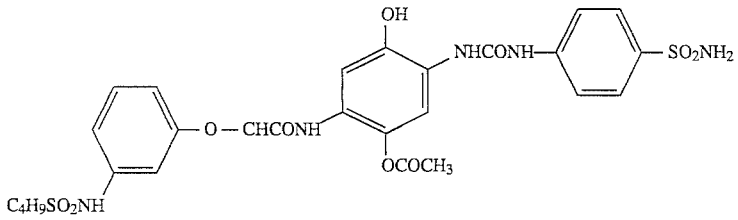
C-44
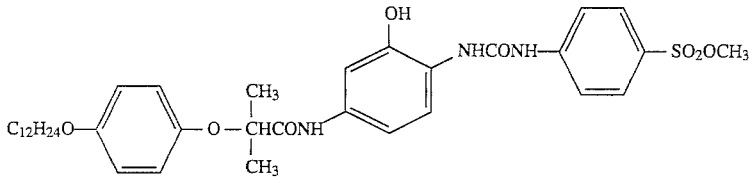
C-45
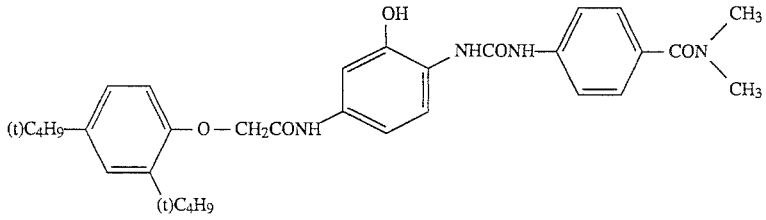

-continued

C-46

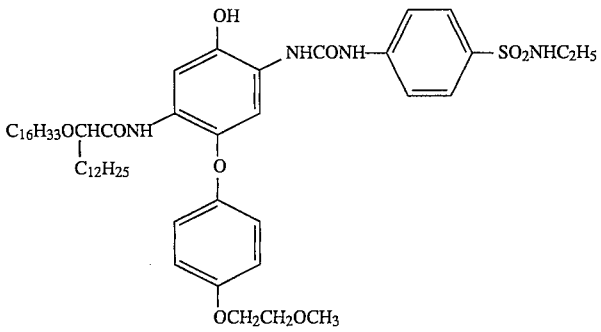

Formula C-C is explained below.

The groups represented by $R_2$ through $R_7$ in Formula C-C each include substituted groups.

For $R_6$, aliphatic groups having 1 to 30 carbon atoms, aromatic groups having 1 to 30 carbon atoms, and heterocyclic groups having 1 to 30 carbon atoms are preferable; for $R_4$ and $R_5$, hydrogen atom and the groups preferable for $R_6$ are preferred.

For $R_2$, is preferable a hydrogen atom bound to NH directly via NH, CO or $SO_2$, aliphatic group having 1 to 30 carbon atoms, aromatic group having 6 to 30 carbon atoms, heterocyclic group having 1 to 30 carbon atoms, $—OR_8$, $—COR_8$,

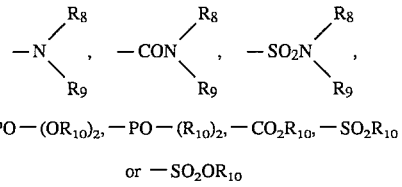

in which $R_8$, $R_9$ and $R_{10}$ each have the same definition as $R_4$, $R_5$ and $R_6$; $R_8$ and $R_9$ may link together to form a heterocycle.

$R_7$ preferably represents an aromatic group having 6 to 30 carbon atoms; typical examples of the substituent for $R_7$ include halogen atoms, hydroxy group, amino group, carboxyl group, sulfon group, cyano group, aromatic group, heterocyclic group, carbonamide group, sulfonamide group, carbamoyl group, sulfamoyl group, ureido group, acyl group, acyloxy group, aliphatic oxy group, aromatic oxy group, aliphatic thio group, aromatic thio group, aliphatic sulfonyl group, aromatic sulfonyl group, sulfamoylamino group, nitro group, imide group, sliphatic group, and aliphatic oxycarbonyl group. When $R_7$ is substituted by more than one substituent, the substituents may link together to form a ring, such as dioxamethylene group.

Typical examples of the group for $R_3$ include halogen atom, hydroxy group, amino group, carboxyl group, sulfon group, cyano group, aromatic group, heterocyclic group, carbonamide group, sulfonamide group, carbamoyl group, sulfamoyl group, ureido group, acyl group, acyloxy group, aliphatic oxy group, aromatic oxy group, aliphatic thio group, aromatic thio group, aliphatic sulfonyl group, aromatic sulfonyl group, sulfamoylamino group, nitro group, and imide group. The number of carbon atoms contained in $R_3$ is preferably 0 to 30. When m=2, the cyclic group for $R_3$ is exemplified by dioxymethylene group.

When 1=1, $R_1$ preferably represents $—CONR_4R_5$, m preferably represents 0, $R_2$ preferably represents $—COR_8$, $—COOR_{10}$, $—SO_2R_{10}$, $—CONR_8R_9$, or $—SO_2NR_8R_9$ in direct bond to NH, more preferably $—COOR_{10}$, $—SOR_8$, or $—SO_2R_{10}$, most preferably $—COOR_{10}$.

Compounds which form a dimer or higher polymer via $R_1$ through $R_3$ and X are also involved in the coupler usable for the present invention.

In Formula C-C, 1 preferably represents 0.

Examples of the coupler represented by Formula C-C are given in Japanese Patent Publication Open to Public Inspection Nos. 60-237448/1985, 61-153640/1986, 65-145557/1986, 62-85242/1987, 48-15529/1973, 50-117422/1975, 52-18315/1977, 52-90932/1977, 53-52423/1978, 54-48237/1979, 54-66129/1979, 55-32071/1980, 55-65957/1980, 55-105226/1980, 56-1938/1981, 56-12643/1981, 56-27147/1981, and 58-95346/1983, and U.S. Pat. No. 3,488,193; these couplers can be synthesized by the methods described in these references.

In adding a coupler to a light-sensitive material, various methods can be used according to coupler properties such as solubility, for example, the oil-in-water emulsifying dispersion method, using water-insoluble high boiling point organic solvent, the alkali dispersion method, in which the coupler is added in alkaline solution, the latex dispersion method, and the solid dispersion method, in which the coupler is directly added in a fine solid.

These couplers are normally added at $1.0\times10^{-3}$ to 1.0 mol per mol silver halide, preferably $5.0\times10^{-3}$ to $8.0\times10^{-1}$.

Typical examples of the cyan couplers represented by Formula C-C may be given as follows. It is, however, to be understood that the investigation sall not be limited thereto. Exemplified Compounds]

C-51
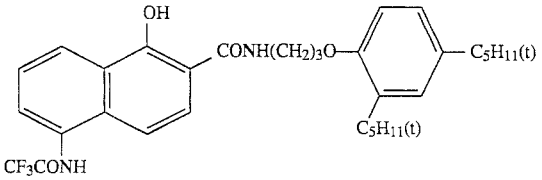
C-52
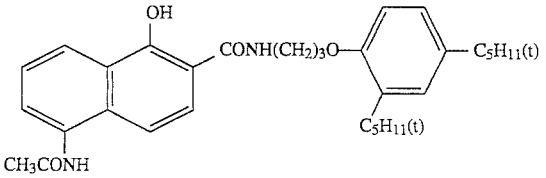
C-53
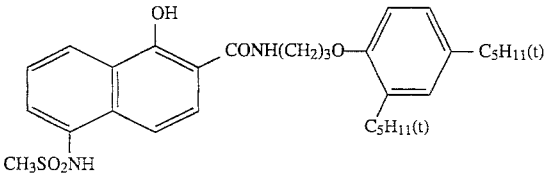
C-54
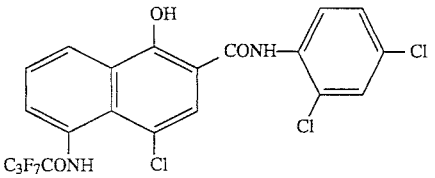
C-55
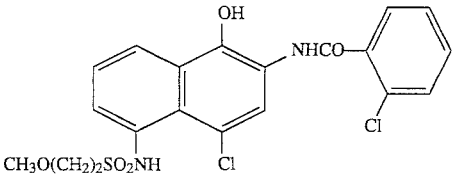
C-56
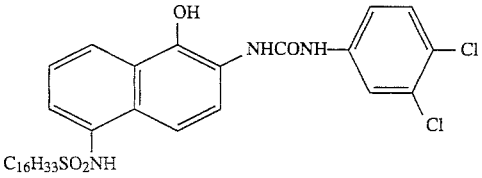
C-57
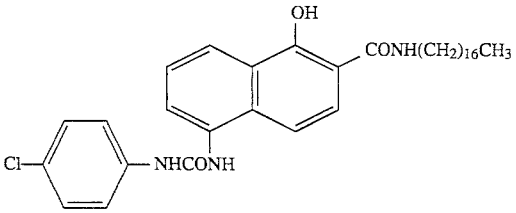
C-58
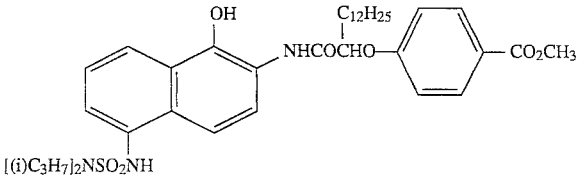

-continued
C-59
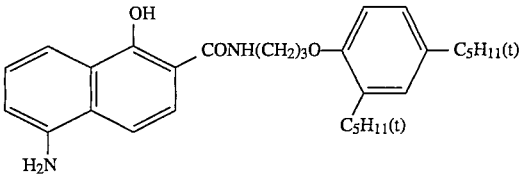
C-60
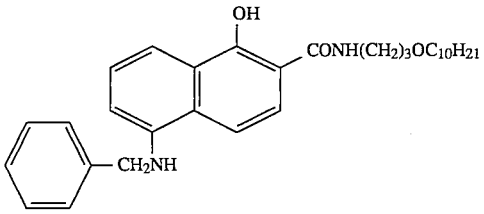
C-61
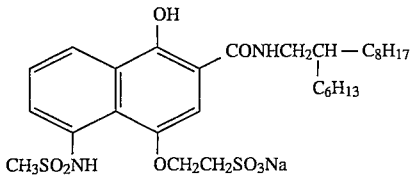
C-62
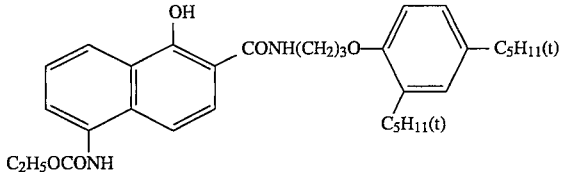
C-63
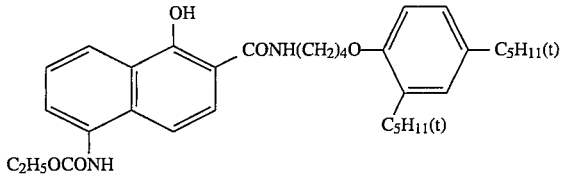
C-64
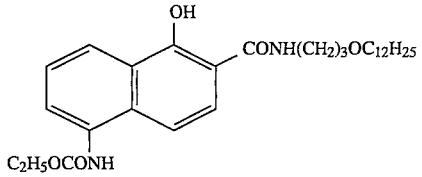
C-65
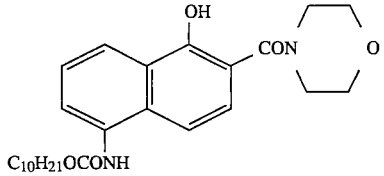
C-66
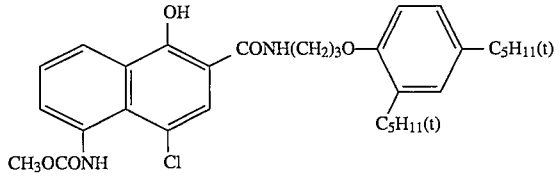

-continued
C-67
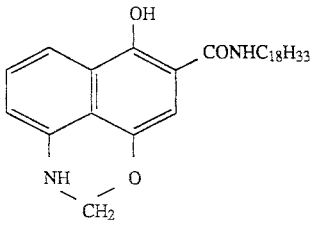
C-68
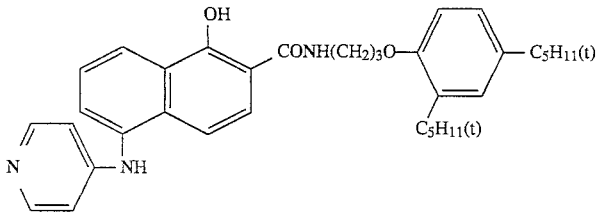
C-69
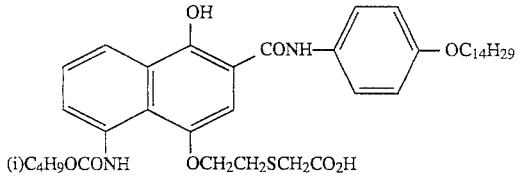
C-70
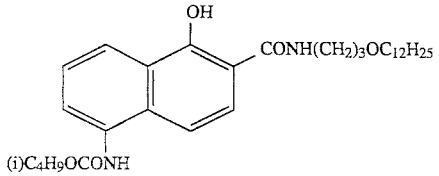
C-71
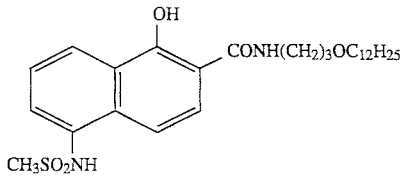
C-72
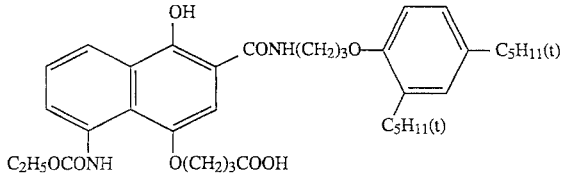
C-73
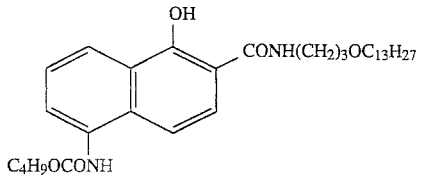
C-74
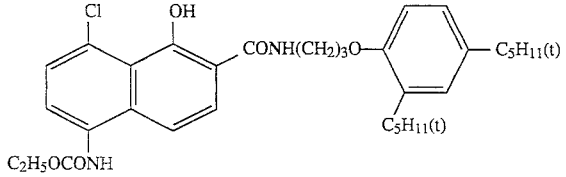

-continued
C-75
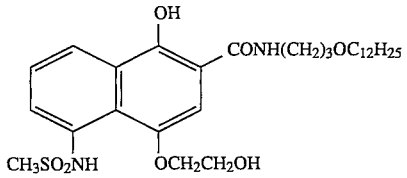
C-76
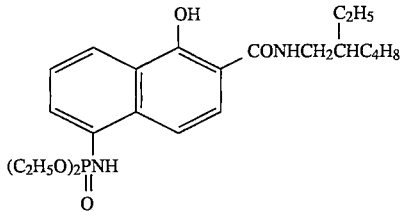
C-77
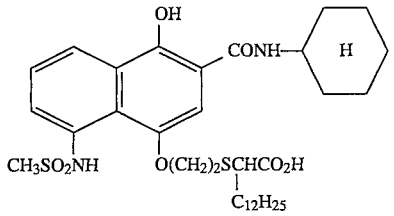
C-78
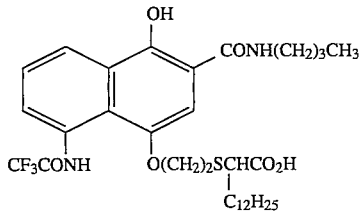
+R2
C-79
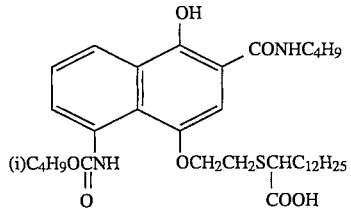
C-80
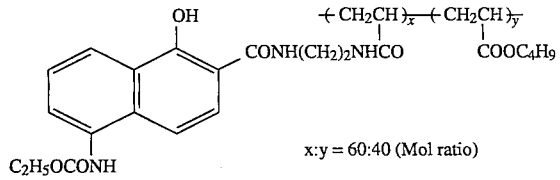
x:y = 60:40 (Mol ratio)
C-81
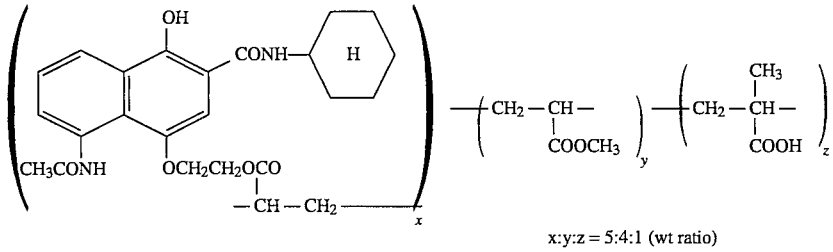
x:y:z = 5:4:1 (wt ratio)

-continued
C-82
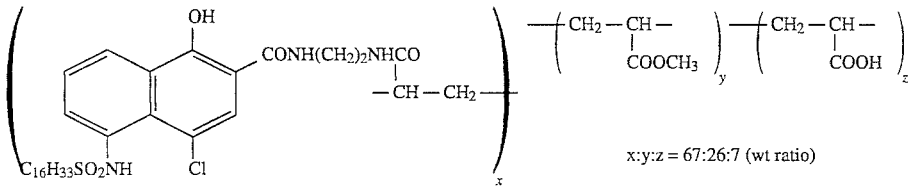
x:y:z = 67:26:7 (wt ratio)
C-83
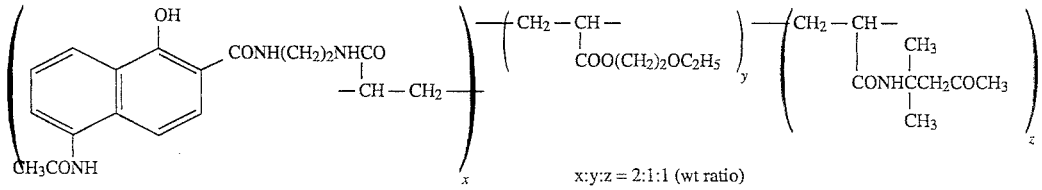
x:y:z = 2:1:1 (wt ratio)
C-84
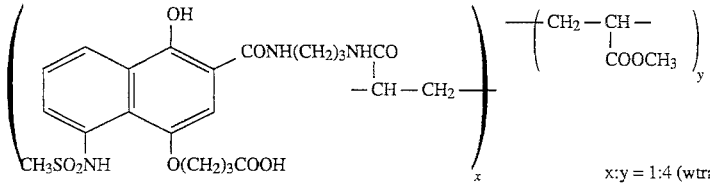
x:y = 1:4 (wtratio)
C-85
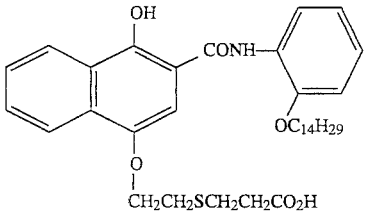
C-86
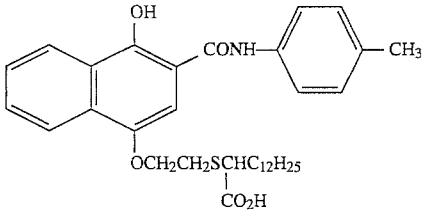
C-87
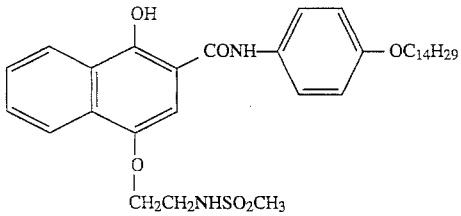
C-88
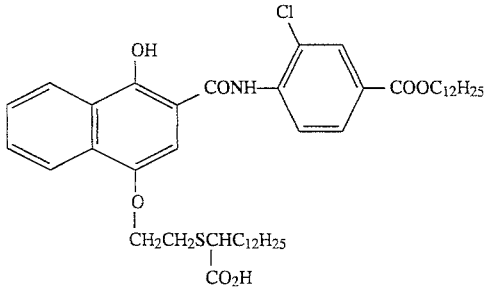

-continued
C-89
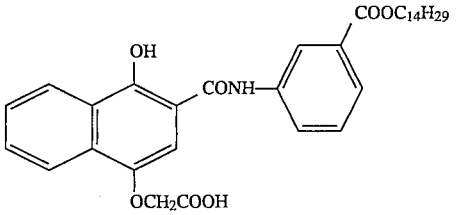
C-90
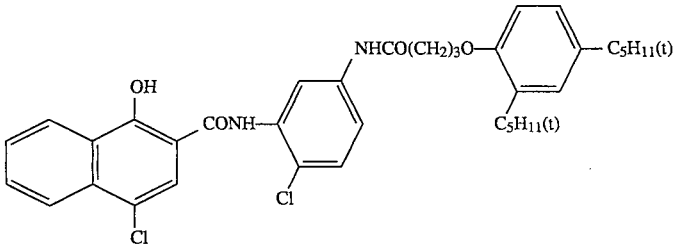
C-91
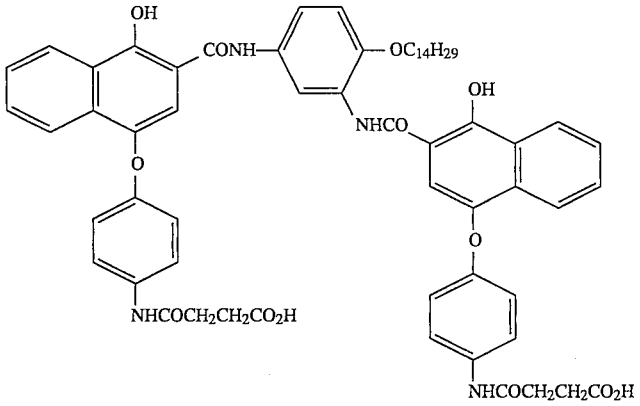
C-92
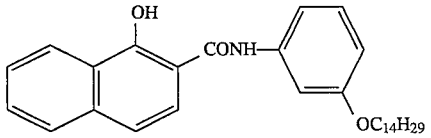
C-93
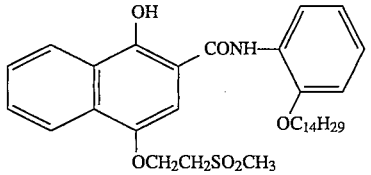
C-94
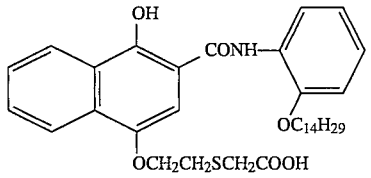
C-95
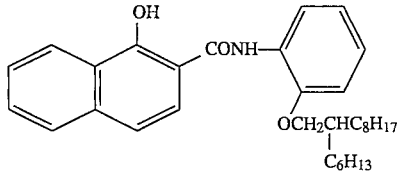

-continued
C-96
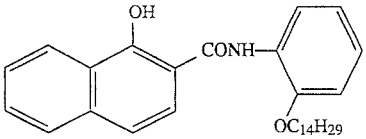
+R2
C-97
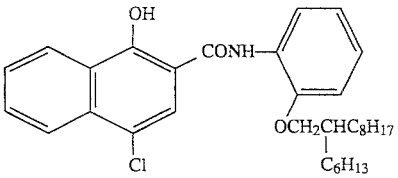
C-98
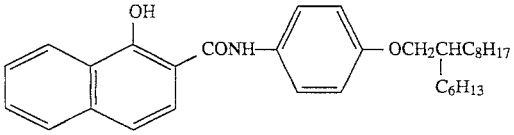
C-99
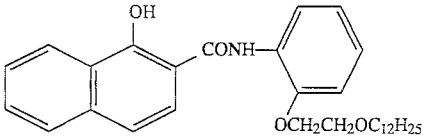
C-100
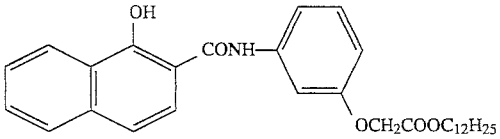
C-101
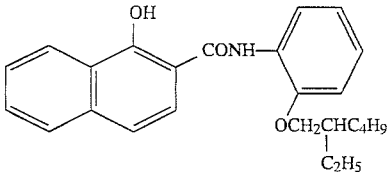
C-102
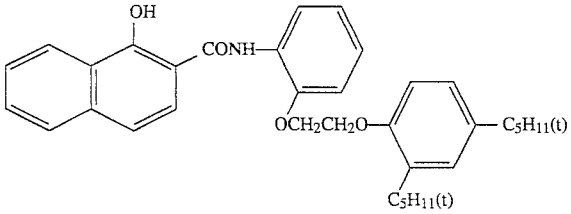
C-103
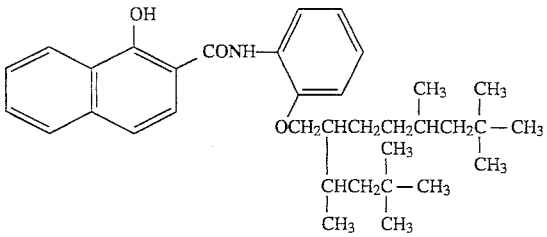

-continued
C-104
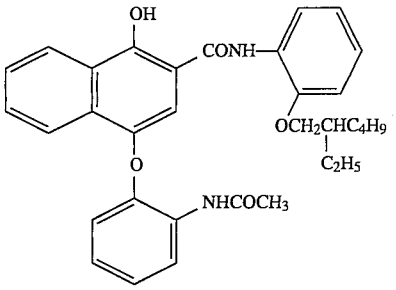
C-105
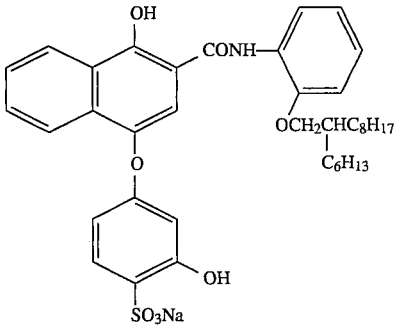
C-106
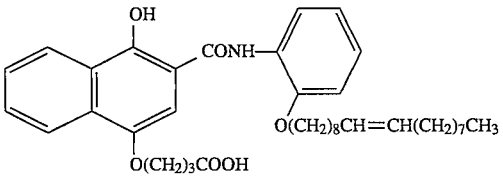
C-107
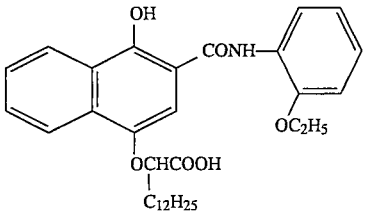
C-108
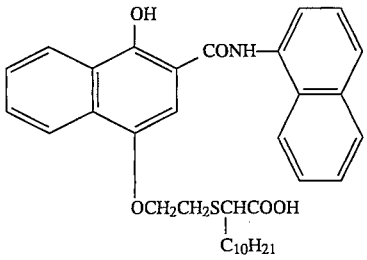
C-109
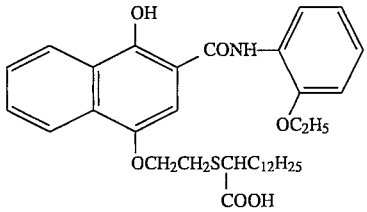

-continued
C-110
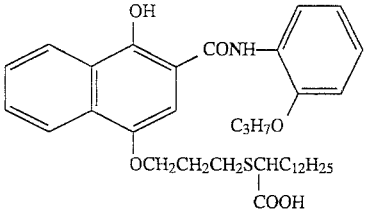
C-111
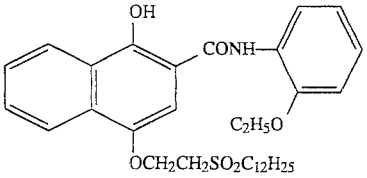
C-112
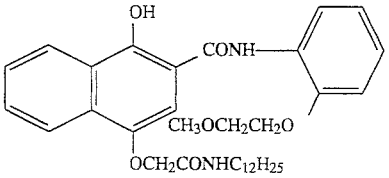
C-113
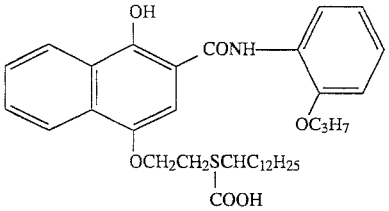
C-114
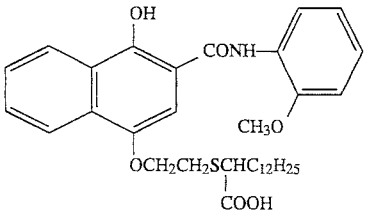
C-115
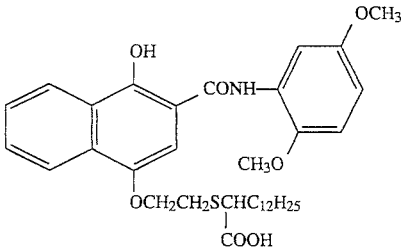
C-116
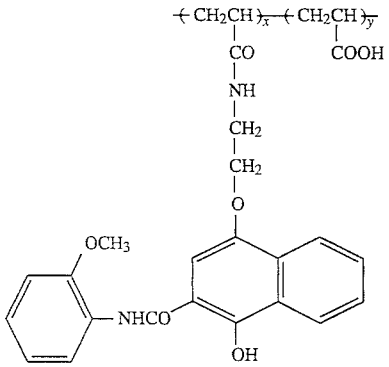
x:y = 50:50
(tN ratio)

-continued

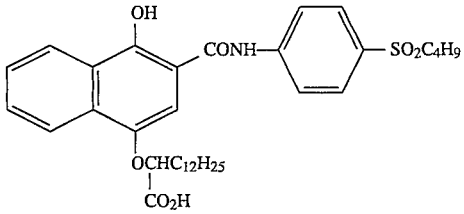

C-117

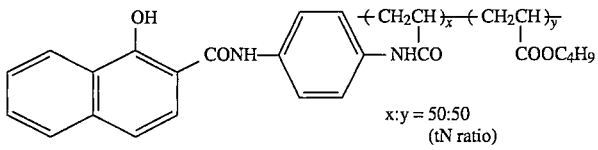

C-118

It is preferable that the silver halide emulsion applicable to the present invention be in the form of tabular grains, and any silver halide can be used, including silver chloride, silver bromide, silver iodide, silver chlorobromide, silver chloroiodide, silver iodobromide, and silver chloroiodobromide. As protective colloids for these silver halides, various substances can be used, as well as natural substance such as gelatin.

The silver halide emulsion may contain ordinary photographic additives, such as stabilizing agents, sensitizing agents, hardeners, sensitizing dyes and surfactants.

Color negative films, color paper, color reversal films, color reversal paper and other light-sensitive materials can be used for the present invention.

The present invention provides a processing method free of bleach fogging and a bleaching solution which functions well in embodying said processing method.

EXAMPLES

Now, referring the the following examples, this invention will be further detailed. It is, however, a matter of course that the invention shall not be limited thereto.

Example-1

In the following examples, every amount of the substances added to silver halide photographic light-sensitive materials is expressed as per weight unit of gram and area unit of square meter, unless otherwise expresslly stated. Further, silver halides and colloidal silver is expressed in terms of silver contents.

Sample-1 of a multilayered color photographic material was prepared by arranging onto a triacetyl cellulose film support with the layers having the following compositions in order from the support side.

| Sample-1 (For comparison) | |
|---|---|
| Black colloidal silver | 0.22 |
| UV absorbent, UV-1 | 0.20 |
| Colored coupler, CC-1 | 0.05 |
| Colored coupler, CM-2 | 0.08 |
| High boiling solvent, Oil-1 | 0.20 |
| Gelatin | 1.2 |
| Layer 2: An interlayer, IL-1 | |
| UV absorbent, UV-1 | 0.01 |
| High boiling solvent, Oil-1 | 0.01 |

-continued

| | |
|---|---|
| Gelatin | 1.3 |
| Layer 3: A low-speed red-sensitive emulsion layer, RL | |
| Silver iodobromide emulsion, Em-1 | 1.0 |
| Silver iodobromide emulsion, Em-2 | 0.5 |
| Sensitizing dye, S-1 | $2.5 \times 10^{-4}$ mol/mol Ag |
| Sensitizing dye, S-2 | $2.5 \times 10^{-4}$ mol/mol Ag |
| Sensitizing dye, S-3 | $0.5 \times 10^{-4}$ mol/mol Ag |
| Cyan coupler, C'-4 | 1.2 |
| Cyan coupler, C'-2 | 0.10 |
| Colored cyan coupler, CC-1 | 0.05 |
| DIR compound, D-1 | 0.002 |
| High boiling solvent, Oil-1 | 0.5 |
| Gelatin | 1.4 |
| Layer 4: A high-speed red-sensitive emulsion layer, RH | |
| Silver iodobromide emulsion, Em-3 | 2.0 |
| Sensitizing dye, S-1 | $2.0 \times 10^{-4}$ mol/mol Ag |
| Sensitizing dye, S-2 | $2.0 \times 10^{-4}$ mol/mol Ag |
| Sensitizing dye, S-3 | $0.1 \times 10^{-4}$ mol/mol Ag |
| Cyan coupler, C'-1 | 0.15 |
| Cyan coupler, C'-2 | 0.03 |
| Cyan coupler, C'-3 | 1.15 |
| Colored cyan coupler, CC-1 | 0.015 |
| DIR compound, D-2 | 0.05 |
| High boiling solvent, Oil-1 | 0.5 |
| Gelatin | 1.4 |
| Layer 5: An interlayer, IL-2 | |
| Gelatin | 0.4 |
| Layer 6: A low-speed green-sensitive emulsion layer, GL | |
| Silver iodobromide emulsion, Em-1 | 1.1 |
| Sensitizing dye, S-4 | $5 \times 10^{-4}$ mol/mol Ag |
| Sensitizing dye, S-5 | $1 \times 10^{-4}$ mol/mol Ag |
| Magenta coupler, M-1 | 0.5 |
| Colored magenta coupler, CM-1 | 0.05 |
| DIR compound, D-3 | 0.015 |
| DIR compound, D-4 | 0.020 |
| High boiling solvent, Oil-2 | 0.5 |
| Gelatin | 1.1 |
| Layer 7: An interlayer, IL-3 | |
| Gelatin | 0.9 |
| High boiling solvent, Oil-1 | 0.2 |
| Layer 8: A high-speed green-sensitive emulsion layer, GH | |
| Silver iodobromide emulsion, Em-3 | 1.2 |
| Sensitizing dye, S-6 | $1.5 \times 10^{-4}$ mol/mol Ag |
| Sensitizing dye, S-7 | $2.5 \times 10^{-4}$ mol/mol Ag |
| Sensitizing dye, S-8 | $0.5 \times 10^{-4}$ mol/mol Ag |
| Magenta coupler, M-2 | 0.08 |
| Magenta coupler, M-3 | 0.18 |
| Colored magenta coupler, CM-2 | 0.05 |
| DIR compound, D-3 | 0.01 |
| High boiling solvent, Oil-3 | 0.5 |

-continued

| | |
|---|---|
| Gelatin | 1.0 |
| Layer 9: A yellow filter layer, YC | |
| Yellow colloidal silver | 0.1 |
| Anti-color-staining agent, SC-1 | 0.1 |
| High boiling solvent, Oil-3 | 0.1 |
| Gelatin | 0.8 |
| Layer 10: A low-speed blue-sensitive emulsion layer, BL | |
| Silver iodobromide emulsion, Em-1 | 0.25 |
| Silver iodobromide emulsion, Em-2 | 0.25 |
| Sensitizing dye, S-10 | $7 \times 10^{-4}$ mol/mol Ag |
| Yellow coupler, Y-1 | 0.6 |
| Yellow coupler, Y-2 | 0.12 |
| DIR compound D-2 | 0.01 |
| High boiling solvent, Oil-3 | 0.15 |
| Gelatin | 1.1 |
| Layer 11: A high-speed blue-sensitive emulsion layer, BH | |
| Silver iodobromide emulsion, Em-4 | 0.48 |
| Silver iodobromide emulsion, Em-1 | 0.20 |
| Sensitizing dye, S-9 | $1 \times 10^{-4}$ mol/mol Ag |
| Sensitizing dye, S-10 | $3 \times 10^{-4}$ mol/mol Ag |
| Yellow coupler, Y-1 | 0.36 |
| Yellow coupler, Y-2 | 0.08 |
| High boiling solvent, Oil-3 | 0.07 |
| Gelatin | 1.2 |
| Layer 12: The 1st protective layer, PRO-1 | |
| Fine-grain silver iodobromide emulsion, - Average grain size: 0.08 μm, - AgI content: 2 mol % - | 0.4 |
| UV absorbent, UV-1 | 0.10 |
| UV absorbent, UV-2 | 0.05 |
| High boiling solvent, Oil-1 | 0.1 |
| High boiling solvent, Oil-4 | 0.1 |
| Formalin scavenger, HS-1 | 0.5 |
| Formalin scavenger, HS-2 | 0.2 |
| Gelatin | 1.0 |
| Layer 13: The 2nd protective layer, PRO-2 | |
| Surfactant, Su-1 | 0.007 |
| Alkali-soluble matting agent, - Average grain size: 2 μm - | 0.10 |
| Cyan dye, AIC-1 | 0.005 |
| Magenta dye, AIM-1 | 0.01 |
| Lubricant, WAX-1 | 0.04 |
| Gelatin | 0.9 |

Each of the above-mentioned layers was further added with coating assistant Su-2, dispersion assistant Su-3, hardeners H-1 and H-2, antiseptics DI-1, stabilizer Stab-1 and antifoggants AF-1 and AF-2, besides the above-given compositions.

Em-1: A monodisperse type emulsion containing a low percentage of silver iodide on the surface;

Average grain size: 0.46 μm

Average silver iodide content: 7.5%

Em-2: A monodisperse type emulsion having a uniform composition;

Average grain size: 0.32 μm

Average silver iodide content: 2.0%

Em-3: A monodisperse type emulsion containing a low percentage of silver iodide on the surface;

Average grain size: 0.78 μm

Average silver iodide content: 6.0%

Em-4: A monodisperse type emulsion containing a low percentage of silver iodide on the surface;

Average grain size: 0.95 μm

Average silver iodide content: 8.0%

Em-1, Em-3 and Em-4 each are silver iodobromide emulsions prepared with reference to each of Japanese Patent O.P.I. Publication Nos. 60-138598/1985 and 61-245151/1986 so that they may have a multilayered struture and compride mainly octahedral grains.

Also, in the emulsions Em-1 through Em-4, the ratios of their grain-sizes to the average grain-thicknesss were 1.0, and the ranges of their grain distributions were 14, 10, 12 and 12%, respectively.

S-1
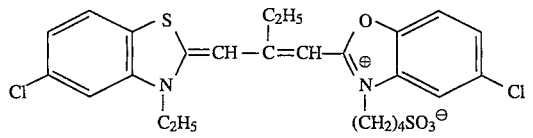
S-2
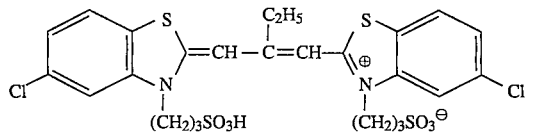
S-3
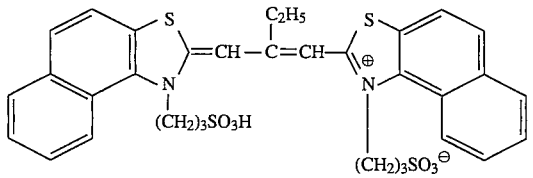
S-4
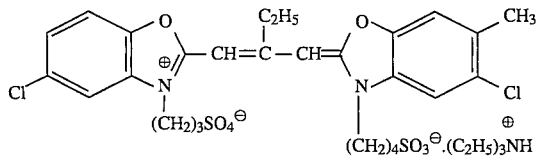
S-5
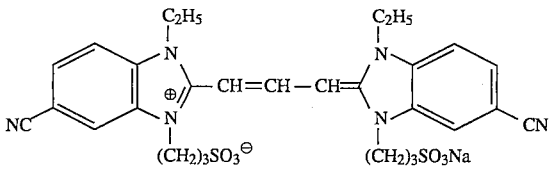
S-6
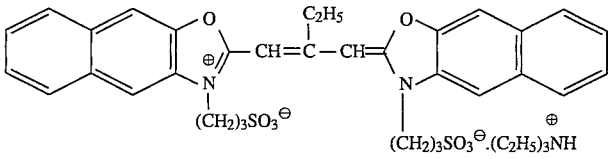
S-7
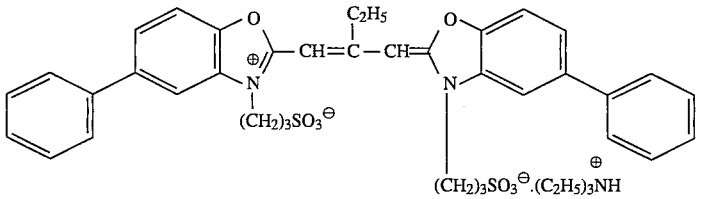
S-8
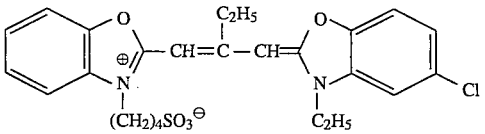
S-9
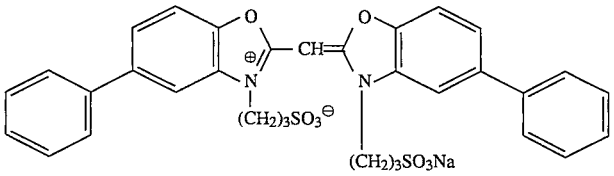
S-10
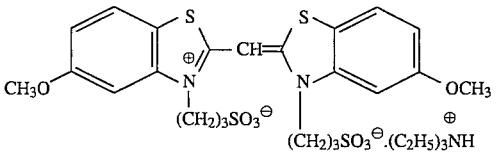

-continued
C'-1
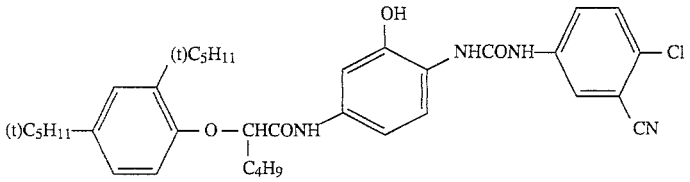
C'-2
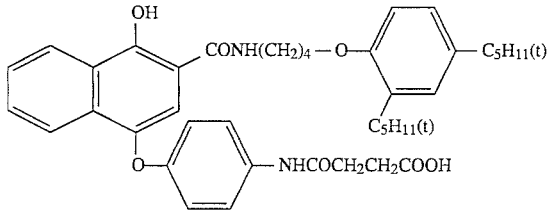
C'-3
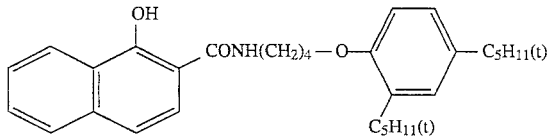
C'-4
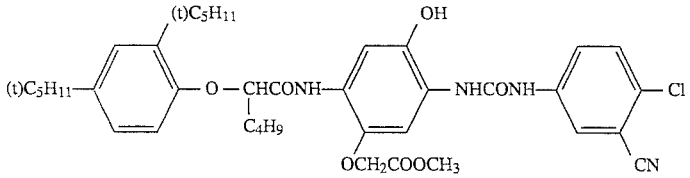
M-1
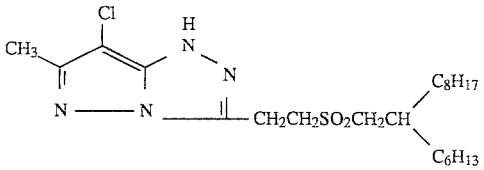
M-2
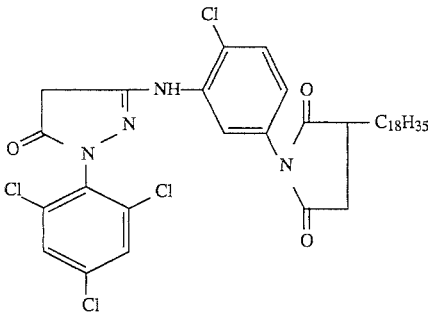
M-3
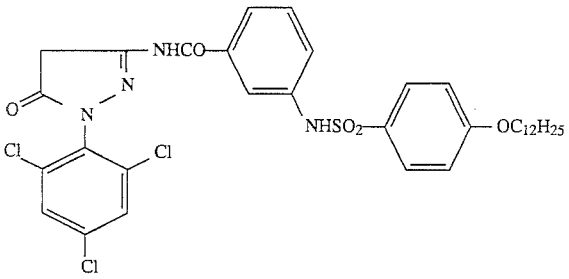

-continued
Y-1
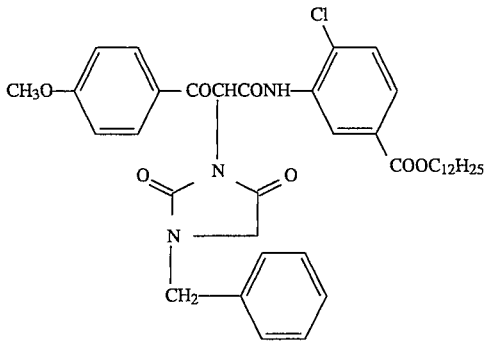
Y-2
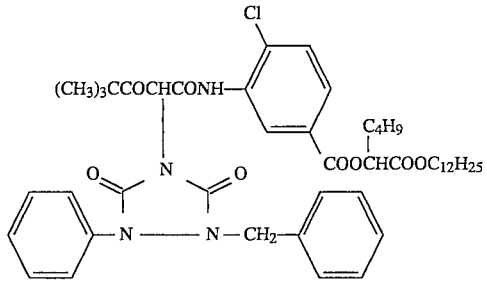
CC-1
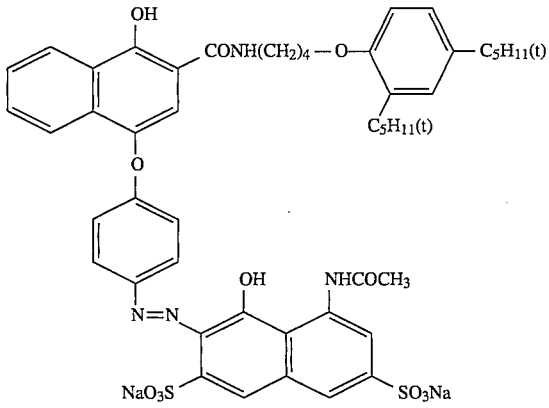
CM-1
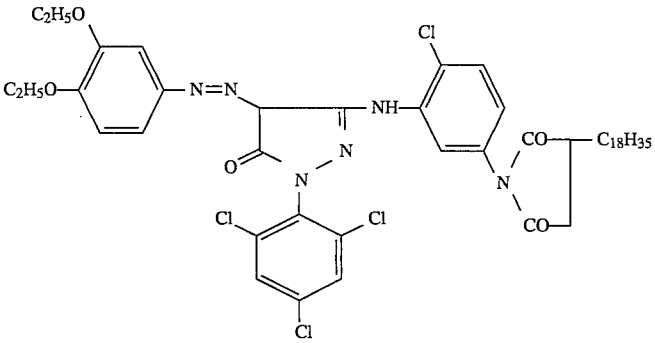
+R2

-continued
CM-2
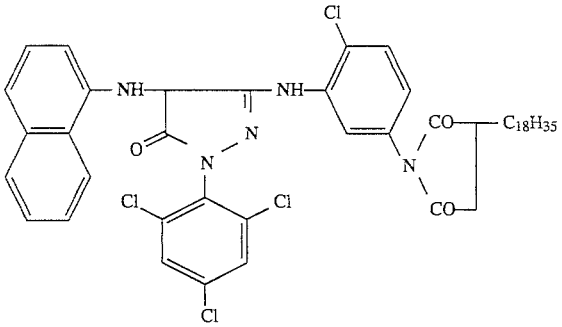
D-1
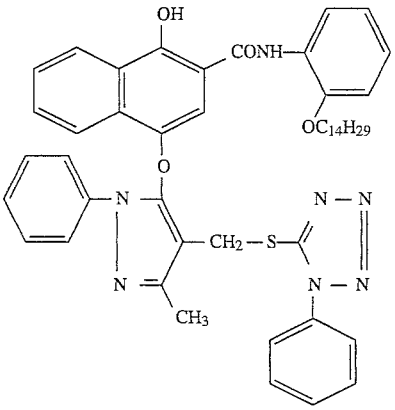
D-2
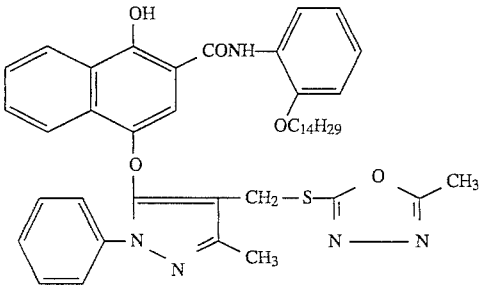
D-3
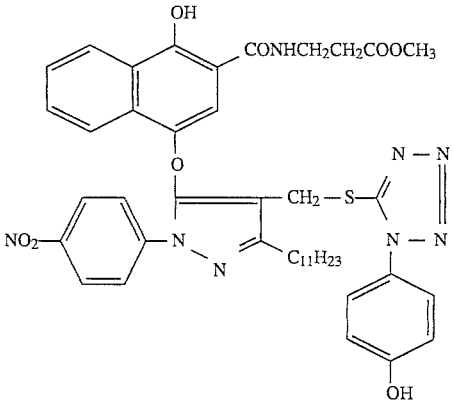

-continued
D-4
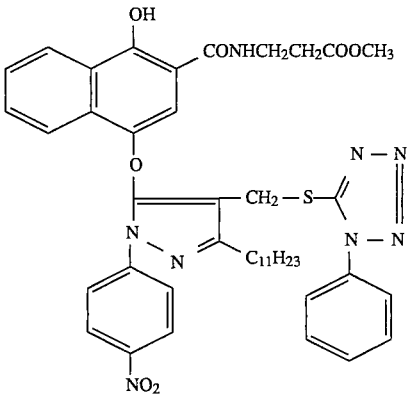
UV-1
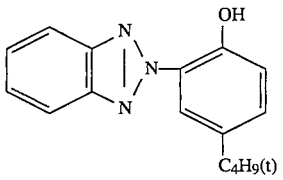
UV-2
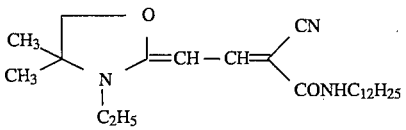
HS-1
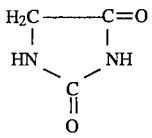
HS-2
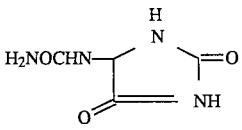
H-1
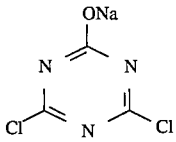
H-2
$[(CH_{2CHSO_2}CH_2)_3CCH_2SO_2(CH_2)_2]_2N(CH_2)_2SO_3K$
Su-1
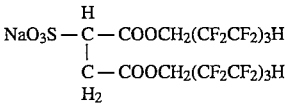
Su-2
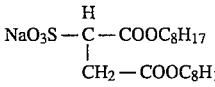
Su-3
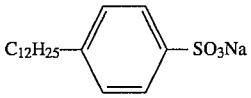

-continued
WAX-1
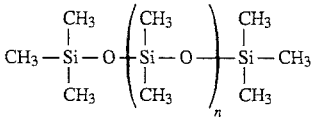
Sc-1
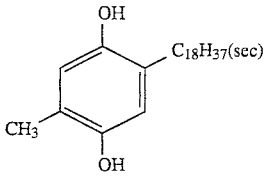
AIC-1
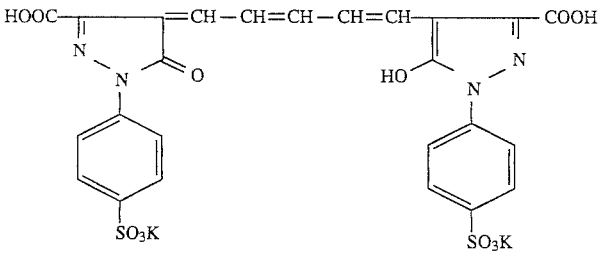
AIM-1
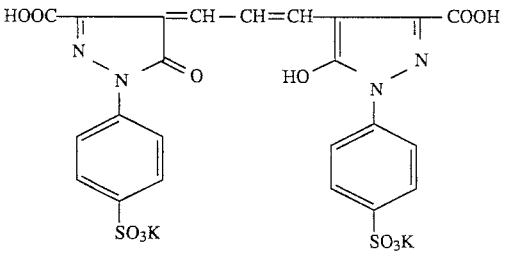
Stab-1
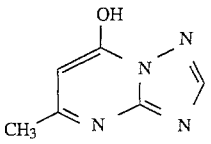
AF-1
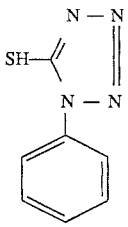
AF-2
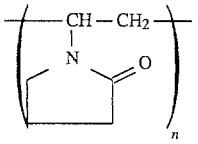
DI-1
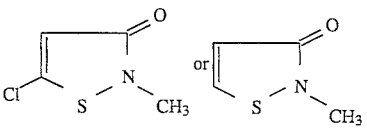
Oil-1
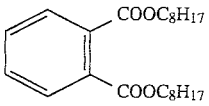

-continued

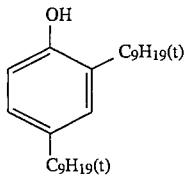

Oil-2

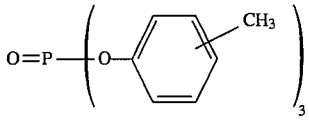

Oil-3

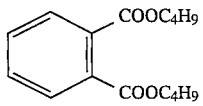

Oil-4

Each of the samples thus prepared was exposed to white light through a wedge and were then processed as follows.

Experimental processing

| Processing step | Processing time | Processing temperature | Number of tank |
|---|---|---|---|
| Color developing | 3 min 15 sec | 38° C. | 1 |
| Bleaching | 45 sec | 38° C. | 1 |
| Fixing | 1 min 30 sec | 38° C. | 1 |
| Stabilizing | 60 sec | 38° C. | 3 (Cascade) |
| Drying | 45 sec | 40 to 80° C. | |

Color developer

| | |
|---|---|
| Potassium carbonate | 30 g |
| Sodium hydrogencarbonate | 2.5 g |
| Potassium sulfite | 4 g |
| Sodium bromide | 1.3 g |
| Potassium iodide | 1.2 mg |
| Hydroxylamine sulfate | 2.5 g |
| Sodium chloride | 0.6 g |
| 4-amino-3-methyl-N-ethyl-N-(β-hydroxyethyl)aniline sulfate | 4.8 g |
| Potassium hydroxide | 1.2 g |
| Add water to make | 1 liter |
| Adjust pH with potassium hydroxide or a 50% sulfuric acid solution to be | pH 10.06 |

Bleaching solution

| | |
|---|---|
| Ferric complex salt of organic acid | See Table-1 |
| Disodium ethylenediaminetetraacetate | 10 g |
| Ammonium bromide | 150 g |
| Glacial acetic acid | 10 ml |
| The foregoing color developer | 200 ml |
| Ammonium nitrate | 30 g |
| Add water to make | 1 liter |
| Adjust pH with aqueous ammonia or glacial acetic acid to | pH 5.8 |

Fixing solution

| | |
|---|---|
| Fixing agent | See Table-1 |
| Ammonium sulfite | 5 g |
| Disodium ethylenediaminetetraacetate | 0.5 g |
| Sodium carbonate | 10 g |
| The foregoing bleaching solution | 100 ml |

-continued

Experimental processing

| | |
|---|---|
| Add water to make | 1 liter |
| Adjust pH with acetic acid or aqueous ammonia to | pH 7.0 |

Stabilizing solution

| | |
|---|---|
| Formaldehyde, in a 37% aqueous solution | 2 ml |
| 5-chloro-2-methyl-4-isothiazoline-3-one | 0.05 g |
| Emulgen 810 (Surfactant) | 1 ml |
| Additional compound of formaldehyde and sodium bisulfite | 2 g |
| Add water to make | 1 liter |
| Adjust pH with aqueous ammonia or a 50% sulfuric acid solution to | pH 7.0 |

Ferric complex salt of organic acids and the fixing agents each of the blaching solutions and fixing solutions were changed as shown in the following Table-1, respectively, and the experiments were then tried, provided , however, that the foregoing bleaching solutions and fixing solutiona were stored at 38° C. for 5 days and were then processed according to the foregoing processing steps.

With respect to thus processed film samples, each of the blue transmission densities thereof was measured in the unexposed areas with a photoelectrodensitometer, Model PDA-65A manufactured by Konica Corporation.

Each of the same processed film samples was further stored at 70% RH and 80° C. for 12 days and each of the blue transmission densities thereof was similarly measured in the same areas. The difference between their blue transmission densities obtained before-storage and after-storage, that is called yellow stain densities.

Also, silver residue in the maximum density area of each sample was measured in a fluorescent X-ray method.

Further, after the fixing solution was stored at 40° C. for two weeks, the appearance thereof was observed.

The results are collectively shown in Table-1, below.

TABLE 1

| Experiment No. | Bleaching solution: Ferric complex salt of organic acid | Bleaching solution: Amount added (mol/l) | Fixing solution: Fixing agent | Fixing solution: Amount added (mol/l) | Yellow stain after 12-day atorage (%) | Appearance of fixing solution | Silver residue (mg/100 $cm^2$) | Remark |
|---|---|---|---|---|---|---|---|---|
| 1-1 | EDTA.Fe | 0.22 | $(NH_4)_2S_2O_3$ | 2.5 | 0.27 | CC | 19.3 | Comp. |
| 1-2 | EDTA.Fe | 0.22 | $NH_4SCN$ | 2.5 | 0.09 | A | 18.6 | Comp. |
| 1-3 | (A-1).Fe | 0.22 | $(NH_4)_2S_2O_3$ | 2.5 | 0.23 | CCC | 1.3 | Comp. |
| 1-4 | (A-1).Fe | 0.22 | $NH_4SCN$ | 2.5 | 0.04 | A | 0.8 | Inv. |
| 1-5 | (A-1).Fe | 0.22 | $NH_4I$ | 2.5 | 0.04 | A | 0.8 | Inv. |
| 1-6 | (A-2).Fe | 0.22 | $NH_4SCN$ | 2.5 | 0.05 | A | 1.0 | Inv. |
| 1-7 | (A-4).Fe | 0.22 | $NH_4SCN$ | 2.5 | 0.05 | A | 1.2 | Inv. |
| 1-8 | (A-7).Fe | 0.22 | $NH_4SCN$ | 2.5 | 0.05 | A | 1.3 | Inv. |
| 1-9 | (A-3).Fe | 0.22 | $NH_4I$ | 2.5 | 0.06 | A | 1.2 | Inv. |
| 1-10 | (A-1).Fe | 0.22 | $NH_4I/(NH_4)_2S_2O_3$ = 3/1 | 2.5 | 0.04 | B–A | 0.9 | Inv. |
| 1-11 | (A-1).Fe | 0.22 | $NH_4I/(NH_4)_2S_2O_3$ = 3/1 | 2.5 | 0.04 | B–A | 0.9 | Inv. |
| 1-12 | (A-1).Fe/EDTA.Fe = 2/1 | 0.25 | $NH_4I$ | 2.5 | 0.05 | A | 0.8 | Inv. |
| 1-13 | (A-1).Fe/EDTA.Fe = 3/1 | 0.25 | $NH_4SCN$ | 2.5 | 0.04 | A | 0.8 | Inv. |

In the above table, EDTA.Fe means ferric ammonium ethylenediaminetetraacetate; (A-1).FE, (A-2).Fe, (A-4).Fe and (A-7).Fe mean ferric ammonium salts of (A-1), (A-2), (A-3), (A-4) and (A-7), respectively.

Also in the table, $NH_4I/(NH_4)_2S_2O_3$=3/1 means that $NH_4I$ and $(NH_4)_2S_2O_3$ were mixedly added together at a mol-ratio of 3:1, and other fractions also express that one and the other are mixedly added together and the mol ratio of the mixture.

Further in the table, Mark A means that an excellent result was obtained without any abnormality at all; mark B means that some contamination was somewhat found; mark C means that some floating matter or precipitate was apparently found; and, the more marks C are multiplied, the more the results become serious.

As is apparent from the table, it is found that yellow stains caused by allowing a processing solution to stand were effectively protected, that any abnormalities such as a precipitation were not particularly found in a fixing solution, that a desilvering reaction had also been completed, and further that a rapid processing aptitude can be displayed.

On the other hand, it is, however, found that some of the above-mentioned effects will be of no avail and the invention will not be put to practical use, if any of the above-mentioned requirements should not be satisfied.

Example-2

The following experiments were tried in the same manner as in Example-1, except that the bleaching solutions used in Experiments No. 1 through No. 13 tried in Example-1 were added with the bleach-accelerators each shown in Table-2 in an amount of 2.0 g per liter.

After the film samples were processed, measurements were made on the silver residues in the maximum density areas and yellow stains produced in the unexposed areas of the samples which had been allowed to stand.

The results thereof are collectively shown in Table-2.

TABLE 2

| Experiment No. | Bleach accelerator | Yellow stain | Silver residue (mg/100 $cm^2$) |
|---|---|---|---|
| 2-0 | Not added | 0.04 | 0.8 |
| 2-1 | (I-1) | 0.02 | 0.4 |
| 2-2 | (II-2) | 0.03 | 0.4 |
| 2-3 | (II-15) | 0.03 | 0.4 |
| 2-4 | (II-27) | 0.01 | 0 |
| 2-5 | (II-24) | 0.01 | 0.1 |
| 2-6 | (III-3) | 0.02 | 0.2 |
| 2-7 | (III-13) | 0.02 | 0.1 |
| 2-8 | (III-14) | 0.01 | 0 |
| 2-9 | (III-15) | 0.02 | 0.4 |
| 2-10 | (IV-1) | 0.03 | 0.3 |
| 2-11 | (V-9) | 0.01 | 0 |
| 2-12 | (V-10) | 0.01 | 0.1 |
| 2-13 | (V-13) | 0.01 | 0.2 |
| 2-14 | (VI-1) | 0.03 | 0.4 |
| 2-15 | (VII-8) | 0.02 | 0.2 |
| 2-16 | (VIII-1) | 0.01 | 0 |
| 2-17 | (VIII-2) | 0.02 | 0.1 |
| 2-18 | (VIII-4) | 0.01 | 0 |
| 2-19 | (VIII-5) | 0.01 | 0.1 |
| 2-20 | (IX-1) | 0.03 | 0.4 |
| 2-21 | (A-1) | 0.03 | 0.3 |
| 2-22 | (A-2) | 0.02 | 0.2 |
| 2-23 | (V-24) | 0.01 | 0.1 |

From Table-2 above, it is found that a rapid processing aptitude can further be promoted and, at the same time, yellow stain can also be improved, when applying a specific bleach accelerator to the processing method of the invention in combination.

Example-3

The experiments were tried in the same manner as in Example-1, except that a vinyl chloride-made nozzle having a 0.5 mm-diameter orifice was provided to both of the bleaching tank and fixing tank each used in, Experiments No. 1 through No. 13, and the emulsion surface of a light-sensitive material was continuously sprayed with a processing solution by means of an Iwaki Magnet Pump MD-15.

As the result, yellow stains and silver residues were were diminished by almost one half.

Example-4

The same experiments were tried by adding EDTA.Fe in an amount of 100 g per liter into the fixing solution used in Experiments No. 1 through No. 13 tried,in Example-1 and the pH of thereof was adjusted to be 7.0. In the experiments, the silver residues were diminished by one half and the other results were almosy the same as those of Example-1.

Example-5

The same experiments were tried by adding the compounda shown in Table-3 each in an amount of 40 g per liter into the fixing solution used in Experiments No. 1 through No. 13 tried in Example-1.

The results thereof are collectively shown in Table-3.

TABLE 3

| Experiment No. | Additive | Yellow stain | Silver residue (mg/100 cm$^2$) |
|---|---|---|---|
| 3-0 | Not added | 0.04 | 0.8 |
| 3-1 | FA-1 | 0.03 | 0.5 |
| 3-2 | FA-12 | 0.02 | 0.4 |
| 3-3 | FA-22 | 0.03 | 0.4 |
| 3-4 | FA-32 | 0.03 | 0.4 |
| 3-5 | FA-38 | 0.03 | 0.5 |
| 3-6 | FA-35 | 0.03 | 0.5 |

From Table-3 above, it is found that the effects of the objects of the invention can be more promoted, when applying the compound represented by the foregoing Formula FA to the processing method of the invention in combination.

Example-6

The processing and the evaluation were carried out in the same manner as in Example-1, except that cyan couplers C'-1 and C'-4, which were added to the film sample used in Experiment 1–4 in Example-1, were replaced by the same mols of the cyan couplers shown in Table-4. The silver residue was resulted in almost the same as in Example-1.

The bleach-fog produced in unexposed areas, that is, the cyan fog density, was also measured.

The results thereof are shown in Table-4.

TABLE 4

| Experiment No. | Cyan coupler | Bleach-fog | Yellow stain |
|---|---|---|---|
| 4-1 | C-1 (Exemplified) | 0.03 | 0.02 |
| 4-2 | C-2 (Exemplified) | 0.03 | 0.03 |
| 4-3 | C-3 (Exemplified) | 0.04 | 0.02 |
| 4-4 | C-8 (Exemplified) | 0.03 | 0.02 |
| 4-5 | C-32 (Exemplified) | 0.03 | 0.03 |
| 4-6 | C-36 (Exemplified) | 0.03 | 0.02 |
| 4-7 | C-70 (Exemplified) | 0.03 | 0.02 |
| 4-8 | C-79 (Exemplified) | 0.03 | 0.02 |
| 4-9 | C-96 (Exemplified) | 0.03 | 0.02 |
| 4-10 | CR-5 | 0.08 | 0.06 |
| 4-11 | C'-3 | 0.07 | 0.06 |

TABLE 4-continued

| Experiment No. | Cyan coupler | Bleach-fog | Yellow stain |
|---|---|---|---|
| | (See Example-1) | | |
| CR-5 | 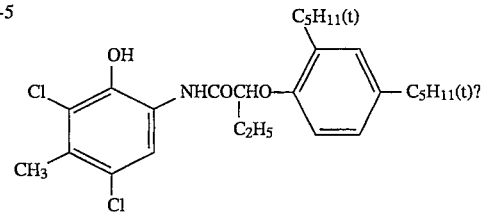 | | |

As is obvious from Table-4 above, it is found that cyan bleach-fog and yellow stain produced by allowing to stand can be improved by changing cyan couplers to the cyan coupler preferably applicable to the invention.

Example-7

The color negative films prepared in Experiment 1–4 in Example-1 were running processed with the processing solutions used in the same experiments and, in addition, with the following replenishing solution.

The compositions of the processing solutions were as follows.

| | |
|---|---|
| Color developer | |
| Potassium carbonate | 40 g |
| Sodium hydrogencarbonate | 3 g |
| Potassium sulfite | 7 g |
| Sodium bromide | 0.5 g |
| Hydroxylamine sulfate | 3.1 g |
| 4-amino-3-methyl-N-ethyl-N-(β-hydroxylethyl)aniline sulfate | 6.0 g |
| Potassium hydroxide | 2 g |
| Add water to make | 1 liter |
| Adjust pH with potassium hydroxide or a 20% aqueous sulfuric acid solution to | pH 10.12 |
| Bleach replenisher | |
| Ferric complex salt of organic acid (See Table-5) | 0.5 mol |
| Disodium ethylenediaminetetraacetate | 2 g |
| Ammonium bromide | 178 g |
| Glacial acetic acid | 21 ml |
| Ammonium nitrate | 35 g |
| Add water to make | 1 liter |
| Adjust pH with aqueous ammonia or glacial acetic acid to | pH 5.6 |
| Fixing replenisher | |
| Fixing agent (See Table-5) | 2.5 mol |
| Sodium bisulfite, anhydride | 5 g |
| Disodium ethylenediaminetetraacetate | 0.8 g |
| Sodium carbonate | 14 g |
| Add water to make | 1 liter |
| Adjust pH with aqueous ammonia and acetic acid to | pH 6.5 |

As for the stabilizing replenisher, the same stabilizing solution as that used in Example-1 was used.

In the running process, the processing steps, processing time, processing temperatures and amounts of replenishers were as follows.

| Processing step | Processing time | Processing temperature | Amount of replenishin* |
|---|---|---|---|
| Color develpoing | 3 min 15 sec. | 38° C. | 650 ml |
| Bleaching | 45 sec. | 38° C. | 140 ml |
| Fixing | 1 min 30 sec. | 38° C. | 800 ml |
| Stabilizing | 60 sec. | 38° C. | 775 ml |
| Drying | 45 sec. | 40 to 70° C. | |

(*Replenishers: In an amount per $m^2$ of a light-sensitive material)

In this example, the fixing tank used was of the dual tank counter-current type. (The total fixing time for the two tanks was 45 seconds.)

The running processing was carried out for 40 days until the bleach replenishers were replenished double as much as the capacity of the bleaching tank. After the film samples were running processed, they were stored as same as in Example-1 and then the yellow stains and silver residues in the maximum density areas of the stored samples were measured.

Further, the appearance of the tank solution of the fixing tank was observed after the running process was completed.

The results thereof are collectively shown in Table-5.

TABLE 5

| Experiment No. | Ferric complex salt of organic acid | Fixing agent | Yellow stain | Appearance of fixing solution | Silver residue (mg/100 $cm^2$) | Remark |
|---|---|---|---|---|---|---|
| 5-1 | EDTA.Fe | $(NH_4)_2S_2O_3$ | 0.32 | CC | 18.9 | Comparative |
| 5-2 | (A-1).Fe | $(NH_4)_2S_2O_3$ | 0.29 | CCCC | 1.4 | Comparative |
| 5-3 | (A-1).Fe | $NH_4I$ | 0.05 | A | 0.9 | Invention |
| 5-4 | (A-1).Fe | $NH_4SCN$ | 0.04 | A | 0.9 | Invention |
| 5-5 | (A-1).Fe/EDTA.Fe = 3/1 | $NH_4SCN$ | 0.04 | A | 0.8 | Invention |
| 5-6 | (A-1).Fe/EDTA.Fe = 2/1 | $NH_4SCN$ | 0.06 | A | 1.0 | Invention |
| 5-7 | (A-1).Fe/EDTA.Fe = 1/1 | $NH_4SCN$ | 0.08 | A | 1.3 | Invention |
| 5-8 | (A-1).Fe/EDTA.Fe = 3/1 | $NH_4I$ | 0.04 | A | 0.8 | Invention |
| 5-9 | (A-1).Fe/EDTA.Fe = 2/1 | $NH_4I$ | 0.06 | A | 0.9 | Invention |

In the table, the expressions are synonymous with those used in Table-1 of Example-1. The meaning of (A-1).Fe/EDTA.Fe=3/1 to 1/1 is that (A-1).Fe and EDTA.Fe were mixed up together in a mol ratio of 3:1 to 1:1 to be added into a bleach replenishing solution so that a total adding amount of iron complex salt of organic acid may be 0.5 mol per liter.

From the table above, it is found in the processing method of the invention that yellow stain production can be excellently improved in allowing to stand, that a precipitation produced in a fixing solution is also excellently improvedd, and that a desilvering property is further excellently improved.

Example-8

The experiments were tried in the same manner as in Example-6, except that the amount of the fixing agent added in Experiment No. 5-3 of Example-6 was changed to those shown in Table-6 below. In this example, the amounts of silver halide residues in the unexposed areas were each measured at the same time.

The results thereof are collectively shown in Table-6.

TABLE 6

| Experiment No. | Amount of NH4I added (mol/l) | Yellow stain | Appearance of fixing solution | Silver residue (mg/100 $cm^2$) | Silver halide residue in unexposed area (mg/100 $cm^2$) |
|---|---|---|---|---|---|
| 6-1 | 0.4 | 0.09 | CC | 3.2 | 15.2 |
| 6-2 | 0.6 | 0.07 | B | 1.7 | 3.2 |
| 6-3 | 0.8 | 0.06 | B–A | 1.4 | 1.8 |
| 6-4 | 1.0 | 0.06 | A | 1.2 | 0.3 |
| 6-5 | 1.5 | 0.06 | A | 1.0 | 0.2 |
| 6-6 | 2 | 0.05 | A | 0.8 | 0 |
| 6-7 | 2.5 | 0.05 | A | 0.8 | 0 |
| 6-8 | 3 | 0.04 | A | 0.8 | 0 |
| 6-9 | 4 | 0.05 | A | 0.8 | 0 |
| 6-10 | 5 | 0.06 | A | 0.9 | 0.2 |

TABLE 6-continued

| Experiment No. | Amount of NH4I added (mol/l) | Yellow stain | Appearance of fixing solution | Silver residue (mg/100 $cm^2$) | Silver halide residue in unexposed area (mg/100 $cm^2$) |
|---|---|---|---|---|---|
| 6-11 | 6 | 0.07 | B–A | 1.2 | 0.7 |

In the table above, the expressions are synonymous with those of Table-1 of Example-1.

From Table-6, it is found that the fixing agent, $NH_4I$, relating to the invention can display the effects of the invention when it is used in an amount of not less than 0.5 mol per liter and, inter alia, when using it in an amount within the range of, preferably, 0.7 to 6 mol, more preferably, 1 to 5 mol and, particularly, 2 to 4 mol per liter.

What is claimed is:

1. A method for forming an image on a silver halide color photographic material, said method comprising;

developing an imagewise exposed silver halide color photographic light-sensitive material with a color developer, bleaching said silver halide color photographic material immediately after said developing, with a bleaching solution, and, treating said silver halide photographic light-sensitive material, after bleaching, with a solution having a fixing capability, wherein said bleaching solution has a pH of 2 to 5.5, and contains a ferric complex salt of Formula A;

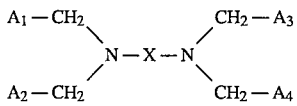

Formula A wherein $A_1$ through $A_4$ are individually $—CH_2OH$, —COOM, or $—PO_3M^1M^2$; M, $M^1$ and $M^2$ are individually hydrogen, sodium, potassium, or ammonium; and X is substituted or unsubstituted alkylene having 3 to 6 carbon atoms;

said bleaching solution is replenished in an amount of 20 to 500 ml/$m^2$ of material, said solution having a fixing capability contains thiocyanate in an amount of not less than 0.5 m/l of said solution, and said silver halide color photographic light-sensitive material comprises at least one cyan dye represented by Formula C-C and C-D

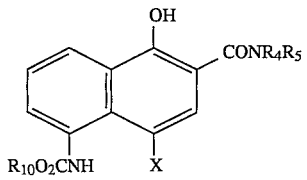

Formula C-C wherein $R_4$, $R_5$, and $R_{10}$ are individually hydrogen, an aromatic group, an aliphatic group, or a heterocyclic group; X is hydrogen or a group capable of being released in a coupling reaction with an oxidation product of an aromatic primary amine-type color developing agent;

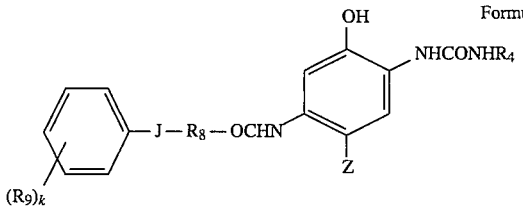

Formula C-D wherein $R_4$ is a substituted or unsubstituted aryl group, $R_8$ is a normal or branched alkylene group having 1 to 20 carbon atoms which may have an aryl group; $R_9$ is hydrogen, halogen, alkyl, aryl, a heterocyclic group, alkoxyl, hydroxyl, acyloxyl, carboxyl, alkyloxycarbonyl, alkylcarbonyl, alkylthio, acyl, acylamino, alkylcarbamide, benzene carbamide, carbamoyl, alkylaminocarbonyl, phenylaminocarbonyl, sulfamoyl, alkylaminosulfonyl, or phenylaminosulfonyl; k is an integer of 0 to 4; J is oxygen, sulfur, or sulfonyl; and Z is hydrogen or a group capable of being released in a coupling reaction with an oxidation product of an aromatic primary amine-type color developing agent.

2. The method of claim 1, wherein said bleaching solution contains said ferric complex salt in an amount of from 0.0 mol to 1.0 mol per liter of said bleaching solution.

3. The method of claim 2, wherein said bleaching solution coantains said ferric complex salt in an amount of from 0.05 mol to 0.4 mol per liter of said bleaching solution.

4. The method of claim 1 wherein said silver halide color Photographic material comprises a support having thereon a silver halide emulsion layer comprising a silver halide emulsion in which an average silver iodide content is 0.1 to 15 mol %.

5. The method of claim 1, wherein said bleaching solution and said solution having fixing capability are forcedly agitated.

6. The method of claim 1, wherein said compound represented by formula A is selected from the group of the following compounds A-1, A-2, A-4 and A-7.

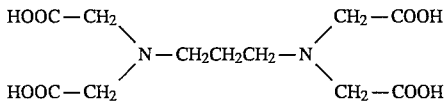

(A-1)

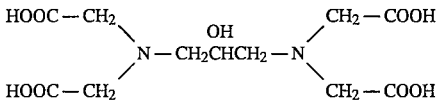

(A-2)

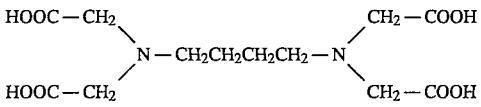

(A-4)

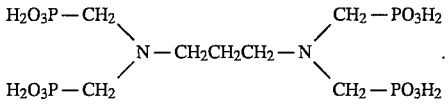

(A-7)

7. The method of claim 1, wherein said solution having a fixing capability contains said thiocyanate in an amount of from 0.7 mol to 6 mol per liter.

8. The method of claim 7, wherein said solution having a fixing capability contains said thiocyanate in an amount of from 1 mol to 5 mol per liter.

9. The method of claim 8, wherein said solution having a fixing capability contains said thiocyanate in an amount of from 2 mol to 4 mol per liter.

10. The method of claim 1, wherein said bleaching step is performed for a time of not more than 1 minute 30 seconds.

11. The method of claim 10, wherein said bleaching step is performed for a time of from 10 seconds to 70 seconds.

12. The method of claim 11, wherein said bleaching step is performed for a time of from 20 seconds to 55 seconds.

13. The method of claim 1, wherein said bleaching step and said treating step with said solution having fixing capability are performed for a time of not more than 3 minutes 45 seconds in total.

14. The method of claim 13, wherein said bleaching step and said treating step with said solution having fixing capability are performed for a time of from 20 seconds to 3 minutes 20 seconds in total.

15. The method of claim 14, wherein said bleaching step and said treating step with said solution having fixing capability are performed for a time of from 40 seconds to 3 minutes in total.

16. The method of claim 15, wherein said bleaching step and said treating step with said solution having fixing capability are performed for a time of from 60 seconds to 2 minutes 40 seconds in total.

* * * * *